US007265281B2

(12) United States Patent
Sasaki et al.

(10) Patent No.: US 7,265,281 B2
(45) Date of Patent: Sep. 4, 2007

(54) AUTOMATIC PLAYER MUSICAL INSTRUMENT HAVING PLAYBACK TABLE PARTIALLY PREPARED THROUGH TRANSCRIPTION FROM REFERENCE TABLE AND COMPUTER PROGRAM USED THEREIN

(75) Inventors: Tomoya Sasaki, Shizuoka-ken (JP); Tsutomu Sasaki, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 312 days.

(21) Appl. No.: 11/102,914

(22) Filed: Apr. 8, 2005

(65) Prior Publication Data

US 2005/0247182 A1 Nov. 10, 2005

(30) Foreign Application Priority Data

May 7, 2004 (JP) ..... 2004-139132

(51) Int. Cl.
*G10F 1/02* (2006.01)
*G10H 1/00* (2006.01)
*G10H 3/00* (2006.01)

(52) U.S. Cl. ..... 84/13; 84/21; 84/600; 84/626; 84/723

(58) Field of Classification Search ..... 84/600, 84/13, 723, 21, 626
See application file for complete search history.

(56) References Cited

U.S. PATENT DOCUMENTS 4,913,026 A * 4/1990 Kaneko et al. ..... 84/21
5,022,301 A * 6/1991 Stahnke ..... 84/21
5,262,586 A * 11/1993 Oba et al. ..... 84/723
5,451,706 A * 9/1995 Yamamoto et al. ..... 84/34
5,530,198 A * 6/1996 Ishii ..... 84/21
5,568,138 A * 10/1996 Mantani ..... 341/20
5,650,580 A * 7/1997 Yamamoto et al. ..... 84/21
5,652,399 A * 7/1997 Fujiwara et al. ..... 84/21
5,663,513 A * 9/1997 Sugiyama et al. ..... 84/21
5,691,489 A * 11/1997 Fujiwara et al. ..... 84/21
5,739,450 A * 4/1998 Fujiwara et al. ..... 84/462
5,880,393 A * 3/1999 Kaneko et al. ..... 84/662
6,051,762 A * 4/2000 Fujiwara et al. ..... 84/21
6,111,174 A * 8/2000 Oba et al. ..... 84/21
6,271,447 B1 * 8/2001 Fujiwara et al. ..... 84/21
6,297,437 B1 * 10/2001 Ura et al. ..... 84/423 R
6,362,405 B2 * 3/2002 Koseki et al. ..... 84/2

(Continued)

FOREIGN PATENT DOCUMENTS

JP 2001-175262 6/2001

*Primary Examiner*—Lincoln Donovan
*Assistant Examiner*—Christina Russell
(74) *Attorney, Agent, or Firm*—Harness, Dickey & Pierce, PLC

(57) ABSTRACT

An automatic player piano is only equipped with key sensors, and the automatic player is expected to give rise to hammer motion to be varied together with the loudness of tones; the manufacturer prepared not only a velocity conversion table expressing a relation between measured values of the hammer velocity and measured values of the reference key velocity but also a reference table expressing a relation between measured values of hammer velocity and target values of reference key velocity through experiments, and the velocity conversion table and reference table were stored in a suitable memory in the automatic player; the automatic player determines a playback table partially through an experiment and partially through transcription from reference table so as to drive the hammers without influence of unstable key motion at large loudness.

20 Claims, 11 Drawing Sheets

U.S. PATENT DOCUMENTS 6,403,872 B2 * 6/2002 Muramatsu et al. ..... 84/724
6,515,213 B2 * 2/2003 Muramatsu et al. ..... 84/687
6,515,565 B1 * 2/2003 Muramatsu et al. ..... 335/299
6,858,789 B2 * 2/2005 Muramatsu et al. ..... 84/600
6,969,791 B2 * 11/2005 Fujiwara ..... 84/13
6,992,241 B2 * 1/2006 Fujiwara ..... 84/21
7,094,961 B2 * 8/2006 Ura et al. ..... 84/600
7,161,137 B2 * 1/2007 Ura et al. ..... 250/222.1
2001/0007220 A1 * 7/2001 Koseki et al. ..... 84/615
2002/0007717 A1 * 1/2002 Uehara ..... 84/600
2003/0070526 A1 * 4/2003 Muramatsu et al. ..... 84/21
2003/0133700 A1 * 7/2003 Uehara ..... 386/96
2005/0092160 A1 * 5/2005 Fujiwara ..... 84/600
2005/0145087 A1 * 7/2005 Fujiwara ..... 84/1
2005/0145781 A1 * 7/2005 Ura et al. ..... 250/222.1
2005/0150361 A1 * 7/2005 Muramatsu et al. ..... 84/626
2005/0211048 A1 * 9/2005 Fujiwara ..... 84/13
2005/0211049 A1 * 9/2005 Fujiwara et al. ..... 84/13
2005/0211079 A1 * 9/2005 Sasaki et al. ..... 84/723
2005/0212846 A1 * 9/2005 Shinkawa et al. ..... 347/19
2005/0235801 A1 * 10/2005 Muramatsu et al. ..... 84/13
2005/0235808 A1 * 10/2005 Ishii et al. ..... 84/600
2006/0016325 A1 * 1/2006 Fujiwara et al. ..... 84/723
2006/0090633 A1 * 5/2006 Muramatsu ..... 84/723

* cited by examiner

| | |
|---|---|
| Velo1 | TIMING T1 |
| Velo2 | TIMING T2 |
| Velo3 | TIMING T3 |
| ⋮ | ⋮ |
| Velo16 | TIMING T16 |

AUTOMATIC PLAYER MUSICAL INSTRUMENT HAVING PLAYBACK TABLE PARTIALLY PREPARED THROUGH TRANSCRIPTION FROM REFERENCE TABLE AND COMPUTER PROGRAM USED THEREIN

FIELD OF THE INVENTION

This invention relates to an automatic player musical instrument and, more particularly, to an automatic player musical instrument such as, for example, an automatic player keyboard musical instrument equipped with an automatic player for reenacting performance on the keyboard and a computer program used therein.

DESCRIPTION OF THE RELATED ART

An automatic player piano is a typical example of the automatic player musical instrument. The automatic player piano is a combination between an acoustic piano and an electronically controlled system, and usually has two modes of operation. The first mode of operation is hereinafter referred to as "recording mode", and the second mode is called as "playback mode". While the automatic player piano is staying the recording mode, a user can request the electronically controlled system, which serves as a recorder, to gather pieces of music data for recording the performance on the keyboard and pedals. On the other hand, when the automatic player piano enters the playback mode, the automatic player piano gets ready to reenact the performance without any fingering of a human player. Upon reception of user's request, the electronically controlled system, which serves as an automatic player, selectively depresses the black and white keys and steps on the pedals for producing the acoustic piano tones along the music passage.

The standard automatic player piano is disclosed in Japanese Patent Application laid-open No. 2001-175262. Hammer sensors are installed in the automatic player piano, and form parts of the recorder. While the user is playing a piece of music on the keyboard and pedals, the hammer sensors monitor the hammers of the acoustic piano, and inform the data processor of the current hammer positions. The data processor analyzes the pieces of hammer data expressing the hammer motion so as to determine the hammer velocity, timing at which the strings are struck with the hammers, and so forth and to estimate for timing at which the associated keys are depressed and released. These pieces of music data are stored in a suitable information storage medium for playback. Thus, the pieces of music data are prepared on the basis of the pieces of hammer data.

Another sort of automatic player pianos is not equipped with any hammer sensor, and is, so to speak, a "hammer sensor-less automatic player piano". Such a hammer sensor-less automatic player piano is equipped with key sensors. The data processor determines the timing at which the black and white keys are depressed and released, and estimates for the hammer velocity and timing at which the strings are struck with the hammers.

When the data processor estimates for the hammer velocity defined in the MIDI (Musical Instrument Digital Interface) protocols, the data processor accesses a table expressing the relation between the key velocity, which is determined on the basis of the pieces of key data, and hammer velocity, and reads out a value of hammer velocity from the table. The relation between the key velocity and the hammer velocity is determined through an experiment carried out by the manufacturer, and is stored in a suitable non-volatile memory of the recorder. The table, in which the relation between the key velocity and the hammer velocity is defined, is hereinafter referred to as "velocity conversion table".

Another table is prepared for the playback, and a relation between the hammer velocity and a reference key velocity is defined in the table. The reference key velocity is defined as "key velocity at a reference key point on the key trajectory between the rest position and the end position", and the reference key point and reference key velocity are disclosed in Japanese Patent Application laid-open No. Hei 7-175472. The reference key velocity is proportional to the hammer velocity, which in tern is proportional to the loudness of the acoustic piano tones. Although the hammer sensor-less automatic player piano is not equipped with the hammer sensors, it is possible to reproduce the acoustic piano tones by controlling the black and white keys to obtain the reference key velocity. While the data processor is selectively driving the solenoid-operated key actuators, which form parts of the automatic player, with the driving pulse signal for the automatic playing, the music data codes teach the hammer velocity so that the data processor reads out the target value of the reference key velocity from the table, and the data processor cooperates with a modulator through a servo-control loop so as to give the target value of the reference key velocity to the black/white keys for reproducing the acoustic piano tones. The table, in which the relation between the hammer velocity and the reference key velocity is stored, is hereinafter referred to as "playback table" in order to discriminate it from the velocity conversion table. The playback table is prepared on the basis of the velocity conversion table, and the work for preparing the playback table is hereinafter referred to as "study".

The prior art hammer sensor-less automatic player piano studies the relation between the hammer velocity and the reference key velocity as follows. First, the data processor reads out a standard value of the reference key velocity from the information storage medium, and controls a black or white key through the servo-control loop. The driving pulse signal is sequentially supplied to the other solenoid-operated key actuators so as to give rise to the key motion. The key sensors monitor the key motion, and supply the pieces of key data to the data processor during the key travel from the rest positions to the end positions. The data processor periodically fetches the pieces of key data, which are represented by the key position signals, and determines a measured value of the reference key velocity. The data processor repeats the above-described sequence at different standard values so that the standard values of the reference key velocity are correlated with the measured values of the reference key velocity.

Subsequently, the data processor accesses the velocity conversion table with the measured values of the reference key velocity, and reads out the values of the hammer velocity. The data processor repeats the above-described sequence, and produces the playback table on the basis of the relation between the measured values of the reference key velocity and the values of the hammer velocity for each key.

While the automatic player is reenacting a performance on the keyboard and pedals, the data processor firstly determines the target values of hammer velocity on the basis of the MIDI music data codes, reads out the target values of the reference key velocity from the playback table, and controls the black and white keys corresponding to the acoustic tones to be produced through the servo-control loop. The black and white keys obtain the target values of reference key velocity at the reference key points, and give rise to the hammer action. The strings are struck with the hammers at the target hammer velocity, and the vibrating strings are expected to produce the acoustic piano tones at the target loudness.

A problem is encountered in the prior art hammer sensor-less automatic player piano in that the hammer sensor-less automatic player piano tends to reproduce the acoustic piano tones at the loudness different from that in the original performance. When the automatic player reproduces the acoustic tones at large loudness, the difference is eminent.

SUMMARY OF THE INVENTION

It is therefore an important object of the present invention to provide an automatic player musical instrument, through which tones are exactly produced at loudness from a small value to a large value.

The present inventors contemplated the problem inherent in the prior art hammer sensor-less automatic player piano, and found that the black and white keys sometimes jumped over the balance rail. The solenoid-operated key actuators were installed under the rear portions of the black and white keys, and the key sensors were located in the area under the front portions of the black and white keys. When the solenoid-operated key actuators slowly projected the plungers, the plungers gave rise to the stable key rotation about the balance rail. However, when the solenoid-operated key actuators were strongly energized with the driving pulse signal, the plungers were violently brought into collision with the rear portions of the black/white keys, and the black and white keys not only rotated about the balance rail but also jumped over the balance rail. For this reason, the pieces of key data did not exactly express the key rotation about the balance rail. Even if the velocity conversion table exactly defined the relation between the reference key velocity and the hammer velocity on a master automatic player piano, which had been installed in the factory of the manufacturer for the velocity conversion table, the key velocity, which were determined on the basis of the pieces of key data in the study, was not reliable, and, accordingly, the playback table was determined under the influence of the error due to the key jump. The present inventors concluded that the part of the playback table, which was accessed for the acoustic piano tones at large loudness, was to be prepared directly through an experiment on the master automatic player piano.

In accordance with one aspect of the present invention, there is provided an automatic player musical instrument for producing tones without fingering of a human player comprising an acoustic musical instrument including plural manipulators selectively manipulated for specifying the tones to be produced and a tone generator having certain links connected to the plural manipulators and responsive to motion of the manipulated manipulators for producing the tones through motion of the certain links connected to the manipulated manipulators and an automatic player including plural actuators respectively associated with the plural manipulators and responsive to a driving signal so as to give rise to the motion of the manipulated manipulators along reference trajectories and a data processing unit connected to the plural actuators, storing a playback relation between target values of the reference velocity and target values of the velocity of the certain links therein, analyzing music data codes representative of at least the manipulated manipulators and loudness of the tones so as to determine the target values of the reference velocity on the basis of the playback relation and controlling the manipulated manipulators to pass through reference points at the reference values of the reference velocity, and reference velocity of the manipulated manipulators at respective reference points on the reference trajectories is proportional to velocity of the associated certain links which in tern is proportional to the loudness of the tones produced through the tone generator, wherein at least a part of the playback relation is prepared through a transcription from a reference relation between target values of the reference velocity and measured values of the velocity of corresponding certain links of a master automatic player musical instrument, which is equipped with sensors for monitoring the corresponding certain links and actuators for driving corresponding manipulators at the target values of the reference velocity.

In accordance with another aspect of the present invention, there is provided a computer program for controlling an automatic player musical instrument for producing tones without fingering of a human player comprising the steps of fetching a music data code representative of at least a pitch of a tone to be produced and loudness of the tone in the form of a target velocity of a certain link forming a part of a tone generator responsive to a manipulator, determining a target value of a reference velocity of the manipulator at a reference point on a reference trajectory with reference to a playback relation, at least a part of which is prepared through a transcription from a reference relation between target values of reference velocity of a corresponding manipulator and measured values of velocity of a corresponding certain link of a master automatic player musical instrument, which is equipped with a sensor for monitoring the corresponding certain link and an actuator for driving the corresponding manipulator, and controlling the manipulator so as to pass through the reference point at the target value of the reference velocity.

BRIEF DESCRIPTION OF THE DRAWINGS

The features and advantages of the automatic player musical instrument and the computer program will be more clearly understood from the following description taken in conjunction with the accompanying drawings, in which.

DESCRIPTION OF THE PREFERRED EMBODIMENT

An automatic player musical instrument embodying the present invention largely comprises an acoustic musical instrument and an electronic system. The acoustic musical instrument includes plural manipulators and a tone generator. In case where the acoustic musical instrument is a piano, black and white keys and the combination of action mechanisms, hammers and strings serve as the manipulators and the tone generator, respectively. In order to make description easily understandable, the acoustic musical instrument is assumed to be the piano. However, the electronic system forms another sort of automatic player musical instrument together with another acoustic musical instrument.

In the following description, term "front" is indicative of a position closer to a pianist, who is sitting on a stool for fingering, than a position modified with term "rear". A line, which is drawn between a front position and a corresponding rear position, extends in a fore-and-aft direction, and a lateral direction crosses the fore-and-aft direction at right angle.

In this instance, the automatic player musical instrument is categorized in the "hammer sensor-less automatic player piano", and only the key sensors are provided under the front portions of the black and white keys, and key actuators are provided under the rear portions of the black and white keys. The key actuators, key sensors and a data processing unit form a servo-control loop so that the data processing unit forces the black and white keys to get target values of the reference key velocity at the reference key points on the reference key trajectories.

The electronic system reenacts a performance on the acoustic musical instrument, and the performance is expressed by a set of music data codes. The data processing unit determines the black and white keys to be moved and the loudness of the tones to be produced on the basis of the music data codes for note-on events. Although the loudness is proportional to the hammer velocity, any hammer sensor is not incorporated in the automatic player musical instrument so that the data processing unit is to estimate the hammer velocity on the basis of piece of key data reported by the key sensors. In this instance, the electronic system prepares a playback table, i.e., a table where a relation between target values of the hammer velocity and target values of the reference key velocity is defined, before the playback, and the data processing unit determines the target values of reference key velocity by means of the playback table, and controls the black and white keys through the servo-control loop so as to adjust the black and white keys to the target values of reference key velocity at the reference key points on the reference key trajectories.

Figure 1A:
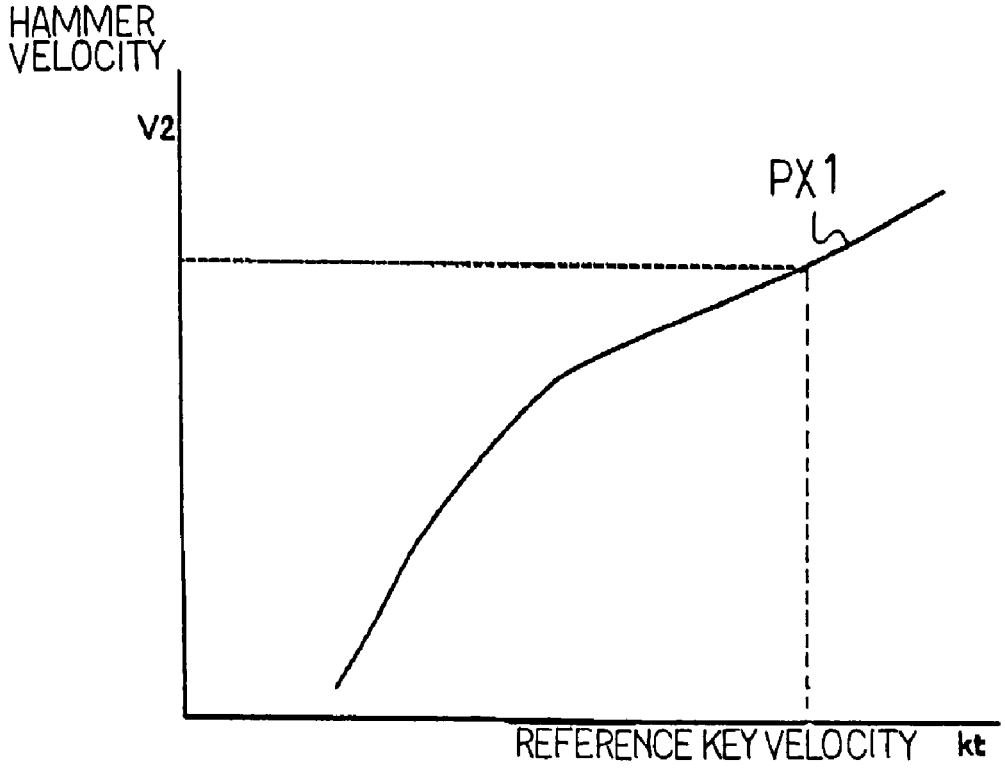
FIG. 1A is a graph showing a relation between target values of the reference key velocity and measured values of the hammer velocity determined through an experiment on a master automatic player piano.
Figure 1B:
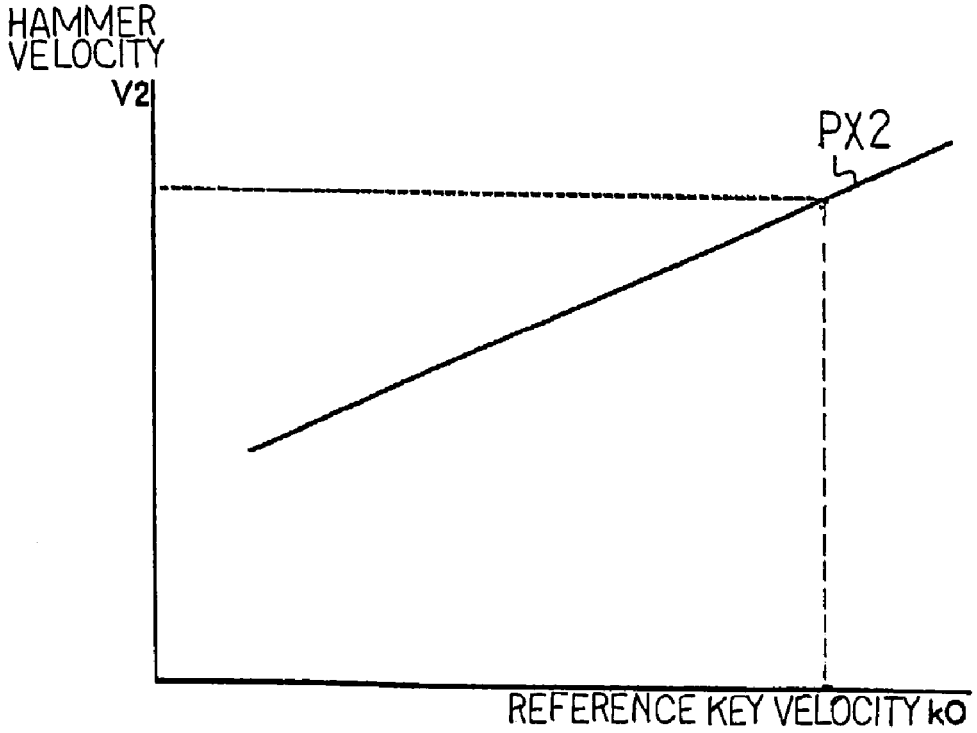
FIG. 1B is a graph showing a relation between measured values of the reference key velocity and measured values of the hammer velocity determined through an experiment on the master automatic player piano.

The playback table is prepared as follows. First, the manufacturer carries out experiments on a master automatic player musical instrument, and determines two relations between the hammers and the black and white keys through experiments. The first relation is to be found between target values of reference key velocity and measured values of hammer velocity, and the second relation is to be found between measured values of reference key velocity and measured values of hammer velocity. In this instance, the experiment for the first relation results in a reference tables, and the experiment for the second relation results in a velocity conversion tables. The relation defined in the reference table is shown in FIG. 1A, and the relation defined in the velocity conversion table is shown in FIG. 1B.

The master automatic player musical instrument also comprises the acoustic musical instrument and an electronic system, which includes hammer sensors, key actuators, key sensors and a data processing unit, so that the hammer action is reported from the hammer sensors to the data processing unit. The key sensors, key actuators and data processing unit form a servo-control loop, and the data processing unit forces the black and white keys to trace the reference key trajectories.

The manufacture firstly gives a target value kt of the reference key velocity for a black and white key to the data processing unit, and the data processing unit forces the black and white key to get the target value at the reference key point on the reference key trajectory through the servo-control. The hammer sensor reports the hammer action to the data processing unit so that the data processing unit correlates the target value kt of reference key velocity with the measured value v2 of the hammer velocity. The manufacturer also gives the target value kt for the other black and white keys to the data processing unit, and the data processing unit correlates the target value kt with the measured values v2 of hammer velocity for the other black and white keys. The manufacturer changes the target value kt, and repeats the experiment for all the black and white keys. As a result, the relation between the target value kt of reference key velocity and the measured values v2 of hammer velocity is defined through the experiment, and is stored as the reference table. Plots PX1 stands for the relation between the target value kt of reference key velocity and the measured values v2 of hammer velocity. Even if the black and white keys exhibit the unstable key motion, the unstable key is not influential in the experiments, because the hammer velocity is determined on the basis of the pieces of hammer data directly reported by the hammer sensors.

Subsequently, the manufacturer gives a standard value of reference key velocity to the data processing unit, and the data processing unit makes the key actuator give rise to the key motion. The data processing unit controls the black and white key to trace the reference key trajectory by means of the servo-control loop. The key action and hammer action are reported from the key sensor and hammer sensor to the data processing unit, and the measured value ko of the reference key velocity is correlated with the measured value v2 of the hammer velocity. The data processing unit carries out the experiment for the other black and white keys, and repeats the experiments at different standard values of reference key velocity. As a result, the measured values of reference key velocity ko are correlated with the measured values v2 of hammer velocity as indicated by Plots PX2, and is stored as a velocity conversion table.

The velocity conversion table is similar to that used in the prior art automatic player musical instrument. However, the reference table is newly prepared for the automatic player musical instrument in accordance with the present invention. Both reference and velocity conversion tables are stored in a suitable memory device incorporated in the electronic system, and, thereafter, the automatic player musical instrument is delivered to a user.

The automatic player musical instrument is assumed to install in a room at user's home. The data processing unit prepares a playback table as follows.

First, the data processing reads out the minimum target value of the reference key velocity from the suitable memory device, and makes the key actuator give rise to the key motion of one of the black and white keys. The data processing unit controls the black and white key through the servo-control loop, and checks the key sensor to see whether or not the key motion results in the strike at the string. If the answer is given negative, the data processing unit increments the target value of reference key velocity, and repeats the servo-control. The key motion is assumed to result in the strike at the string. Then, the data processing unit determines the measured value ko of reference key velocity on the basis of the pieces of key data reported from the associated key sensor, and correlates the target value kt of reference key velocity with the measured value v2 of hammer velocity through the velocity conversion table.

The data processing unit further increments the target value kt of reference key velocity, and correlates the target value kt of reference key velocity with the measured values v2 of hammer velocity with the assistance of the velocity conversion table. While the target values kt of reference key velocity are fallen within a lower-to-medium velocity range, the data processing unit correlates the target values kt of reference key velocity with the measured values v2 of hammer velocity through the data conversion table.

Figure 1C:
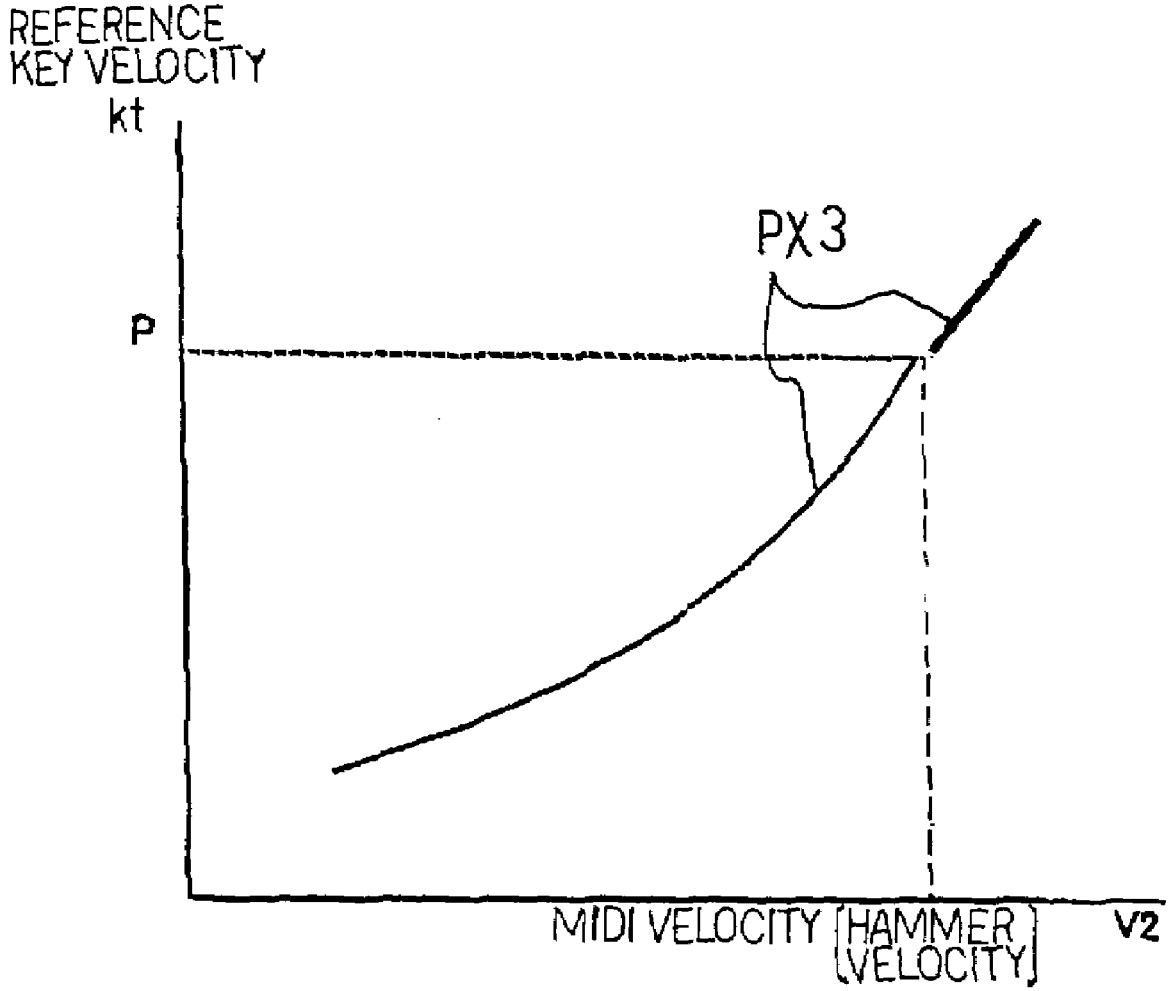
FIG. 1C is a graph showing target values of the hammer velocity and target values of the reference key velocity determined through a study.

When the target value kt reaches a critical value P, at which the black and white keys exhibits the unstable key motion, the data processing unit transcripts a part of Plots PX1 from the reference table, and connects the part of Plots PX1 to the plots determined with the assistance of the data conversion table. As a result, the relation between the target values kt and the measured values v2 is determined as indicated by Plots PX3 in FIG. 1C.

As will be understood from the foregoing description, the playback table is prepared partially through the study and partially through the transcription from the reference table. As described hereinbefore, the reference table, which was prepared through the experiment on the master automatic player musical instrument, is free from the influence of unstable key motion, and, accordingly, the playback table is reliable.

The user is assumed to wish to reenact the performance expressed by a set of music data codes. The set of music data codes is loaded to the electronic system, and the data processing unit sequentially processes the music data codes. When the data processing unit fetches a music data code representative of the note-on event, the data processing unit specifies a black or white key to be moved, the loudness of the tone to be produced and time to produce the tone. As described hereinbefore, the loudness is given as a target value of hammer velocity. The data processing unit accesses the playback table, and reads out a target value kt of reference key velocity corresponding to the value of hammer velocity. The data processing unit determines the reference key trajectory for the black or white key, and forces the black or white key to trace the reference key trajectory through the servo-control loop. For this reason, the black or white key gets the target value kt of reference key velocity at the reference key point on the reference key trajectory, and the black or white key gives rise to the hammer motion. The hammer gets the target value of hammer velocity immediately before the strike at the string, and gives rise to vibrations of the string. The tone is radiated from the vibrating string at the target loudness. Thus, the playback table is conducive to the faithful playback.

Even if the music data code requests the hammer sensor-less automatic player piano to produce a tone at large loudness, the data processing unit can determine the target value of reference key velocity through the playback table, and the target value of reference key velocity is free from the unstable key motion. Thus, the hammer sensor-less automatic player piano according to the present invention faithfully reenacts the performance.

Structure of Automatic Player Piano

Figure 2:
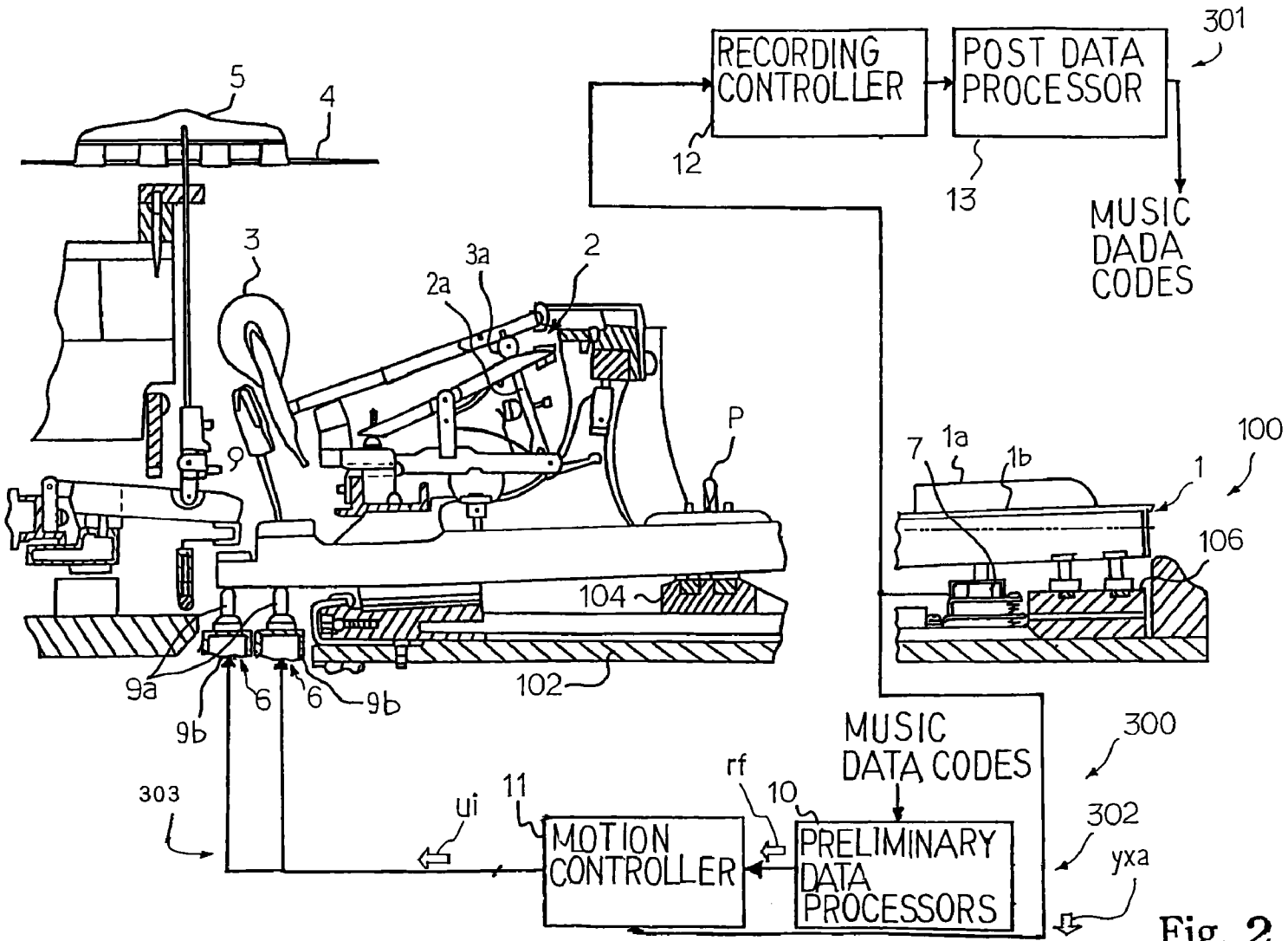
FIG. 2 is a side view showing the structure of an automatic player piano according to the present invention.

Referring to FIG. 2 of the drawings, an automatic player piano largely comprises an acoustic piano 100 and an electronic system 300, and selectively enters at least a standard mode, a recording mode and a playback mode depending upon user's mode instruction. The acoustic piano 100 is a grand piano, and the electronic system 300 is installed in the acoustic piano 100.

The user plays a piece of music through fingering on the acoustic piano 100 in the standard mode, and acoustic piano tones are produced through the acoustic piano 100. Thus, the automatic player piano behaves as a standard acoustic piano in the standard mode.

When the user gives the mode instruction for the recording mode to the automatic player piano, the main routine program periodically branches the subroutine program for the recording, and the electronic system 300 gets ready to record performance on the acoustic piano 100. While the user is fingering on the acoustic piano 100, the electronic system 300 obtains pieces of key data representative of the key motion and pieces of pedal data representative of pedal motion, and analyzes the pieces of key data and pieces of pedal data so as to produce music data codes representative of the acoustic tones produced in the performance. The music data codes are supplied to an external data source in a real time fashion, and/or are stored in a memory. Thus, the performance on the acoustic piano 100 is recorded through the electronic system 300 in the recording mode.

On the other hand, the electronic system 300 reenacts the performance, and reproduces the acoustic piano tones through the acoustic piano 100 on the basis of a set of music data codes representative of the performance. The set of music data is read out from a suitable memory. Otherwise, the electronic system 300 requests an external data source to transmit the set of music data through a cable or a public communication network.

While the music data codes are sequentially being processed, the electronic system 300 determines the pitch, timing at which the acoustic piano tones are to be produced, hammer velocity or loudness, timing at which the acoustic piano tones are to be decayed and effects to be imparted to the acoustic piano tones, if any, along the music passage, and plays the music passage on the acoustic piano 100 without any fingering of a human player.

A set of playback tables is partially prepared through the study. However, the remaining part of the set of playback tables is prepared on the basis of the reference table. The part of the set of playback tables is accessed for producing the acoustic piano tones at small to middle loudness. On the other hand, the remaining part of the set of playback tables is accessed for producing the acoustic tones at large loudness.

The manufacturer prepares a set of reference tables through experiments, where the hammer velocity, the values of which are actually measured, is correlated with values of the reference key velocity given by the manufacturer. In the playback mode, the electronic system 300 accesses the set of playback tables so as to determine the target values of reference key velocity, and controls the key motion on the reference key trajectories as will be hereinlater described in detail.

Acoustic Piano

The acoustic piano 100 includes a keyboard 1, action units 2, hammers 3, strings 4 and dampers 5. The keyboard 1 is mounted on a front portion of a key bed 102, which defines the bottom of a piano cabinet, and the action units 2, hammers 3, strings 4 and dampers 5 are housed in the piano cabinet.

An array of black keys 1*a* and white keys 1*b* is incorporated in the keyboard 1. The black keys 1*a* and white keys 1*b* are elongated in the fore-and-aft direction, and are laterally laid on the well-known pattern. In this instance, eighty-eight black and white keys 1*a*/1*b* form the array. The black keys 1*a* and white keys 1*b* pitch up and down on a balance rail 104, and balance pins P keep the black keys 1*a* and white keys 1*b* on the balance rail 104. Front pins guide the black keys 1*a* and white keys 1*b* toward a front rail 106 so that the front portions of black keys 1*a* and front portions of white keys 1*b* reciprocally travel on predetermined trajectories.

The black and white keys 1*a*/1*b* are staying at respective rest positions without any external force exerted on the front portions thereof. The rest positions are located at stroke of zero, and the black keys 1*a* and white keys 1*b* at the rest positions are drawn by real lines in FIG. 1. When the external force is exerted on the front portions of the black and white keys 1*a*/1*b*, the front portions are sunk toward respective end positions. In this instance, the end positions are located at 10 millimeters under the rest positions, and dots-and-dash line is indicative of the upper surfaces of the white keys 1*b* at the end position in FIG. 2.

The black and white keys 1*a*/1*b* are respectively linked at the rear portions thereof with the action units 2, and the action units 2 give rise to free rotation of the hammers 3. The strings 4 are stretched over the hammers 3, and dampers 5 are linked with the rearmost portion of the black and white keys 1*a*/1*b* so as to be spaced from and brought into contact with the strings 4.

While the black and white keys 1*a*/1*b* are staying at the rest positions, the hammers 3 are held in contact at hammer rollers 3*a* thereof with the heads of jacks 2*a*, which form parts of the action units 2, and the dampers 5 are held in contact with the strings 4 as shown in FIG. 2. A pianist is assumed to depress one of the black and white keys 1*a*/1*b*, the depressed key 1*a*/1*b* pitches, and the front portion is sunk toward the end position. The damper 5 is spaced from the string 4 on the way of the depressed key 1*a*/1*b* toward the end position, and permits the strings 4 to vibrate. Moreover, the depressed key 1*a*/1*b* gives rise to the motion of the action unit 2, and the jack 2*a* escapes from the hammer roller 3*a* on the way of the depressed key 1*a*/1*b* toward the end position. Then, the pianist feels the depressed key 1*a*/1*b* lighter than before.

When the jack 2*a* escapes from the hammer roller 3*a*, the hammer 3 starts the free rotation toward the string 4. The hammer 3 is brought into collision with the string 4 at the end of the free rotation, and gives rise to the vibration of the string 4. The string vibrations give rise to the acoustic piano tone at the given pitch.

The hammer 3 rebound on the string 4, and is received by the action unit 2. When the pianist releases the depressed key 1*a*/1*b*, the released key 1*a*/1*b* starts to return toward the rest position. The damper 5 is brought into contact with the vibrating string 4 on the way of the released key 1*a*/1*b* toward the rest position so that the acoustic piano tone is decayed. When the released key 1*a*/1*b* arrives at the rest position, the action unit 2 and hammer 3 return to their rest positions as shown in FIG. 2.

Electronic System

The electronic system 300 serves as a recorder 301 in the recording mode and an automatic player 302 in the playback mode. The function of the recorder 301 is broken down into a recording controller 12 and a post data processor 13. On the other hand, the function of the automatic player 302 is broken down into a preliminary data processor 10 and a motion controller 11. The recording controller 12, post data processor 13, preliminary data processor 10 and a motion controller 11 are realized through a computer program running on a data processing unit 303, the system configuration of which will be hereinlater described with reference to FIG. 3.

The electronic system 300 further includes an array of solenoid-operated key actuators 6, an array of key sensors 7, solenoid-operated pedal actuators (not shown) and pedal sensors (not shown). The plungers and solenoids are labeled with references 9*a* and 9*b*, respectively. A slot is formed in the key bed 102 under the rear portions of the black and white keys 1*a*/1*b*, and is laterally elongated. The solenoid-operated key actuators 6 are hung from the key bed 102, and are laterally arrayed under the rear portions of the black/white keys 1*a*/1*b*. The solenoids 9*b* are disposed in the slot, and the data processing unit 303 is connected to the solenoids 9*b*. The plungers 9*a* are upwardly directed, and the tips of plungers 9*a* are in the proximity of the lower surfaces of the rear portions of the associated black and white keys 1*a*/1*b*. When the data processing unit 303 determines a key 1*a*/1*b* to be moved, the data processing unit 303 supplies a driving pulse signal ui to the solenoid 9*b* associated with the key 1*a*/1*b*. Then, the solenoid 9*b* creates magnetic field, and the magnetic force is exerted on the plunger 9*a* in the magnetic field. The plunger 9*a* upwardly projects from the solenoid 9*b*, and pushes the rear portion of the key 1*a*/1*b* so as to give rise to the key motion.

The key sensors 7 are of the type radiating light beams across the trajectories of the front portions of the black and white keys 1*a*/1*b*. In other words, the key sensors 7 are implemented by non-contact optical sensors. The key sensors 7 are arrayed on the key bed 102 in the lateral direction, and are operative to convert current key positions on the key trajectories to analog key position signals yxa. Since the cross sections of the light beams are overlapped with the full keystrokes between the rest positions and the end positions, it is possible continuously to express the current key positions between the rest positions and the end positions in the key position signals yxa. The current key position is equivalent to the stroke from the rest position. In this instance, the end positions are spaced from the corresponding rest positions by 10 millimeters. The current key position has a value from zero to 10 in millimeter.

The key position signals yxa are supplied to the recording controller 12 in the recording mode and to the motion controller 11 in the playback mode. While the electronic system 300 is serving as the recorder 301, the recording controller 12 analyzes the pieces of key data expressed by the key position signals yxa so as to determine the key motion, supplies the pieces of music data, which express the performance, to the post data processor 13, and the post data processor 13 encodes the pieces of normalized music data in the formats defined in the MIDI protocols. In the normalization process, the post data processor 13 eliminates noise components due to the individualities of the acoustic piano 100 and individuality of the key sensors 7 from the pieces of music data.

On the other hand, while the electronic system 300 is serving as the automatic player 302, the preliminary data processor 10 analyzes the music data codes so as to determine reference key trajectories, which are target key positions varied with time, and the motion controller 11 compares the current key positions and current key velocity, which is calculated on the basis of the pieces of key data, with target key positions and target key velocity to see whether or not the black keys 1*a* and white keys 1*b* are traveling on the reference key trajectories. If the black keys 1*a* and white keys 1*b* are deviated from the reference key trajectories, the motion controller 11 varies the mean current or duty ratio of the driving pulse signal ui so as to force the black keys 1*a* and white keys 1*b* to travel on the reference key trajectories. The black/white keys 1*a*/1*b* travelling on the reference key trajectories give rise to the hammer motion, and adjusts the hammers 3 to target values of hammer velocity expressed in the music data codes. Thus, the key position signals yxa are used in a servo control on the solenoid-operated key actuators 6, and the solenoid-operated key actuators 6, key sensors 7 and motion controller 11 form a servo-control loop.

The current key velocity is determinable through the differentiation on a function expressing a series of current key positions. In a practical use, two reference key points are determined on each of the key trajectories, and the current key velocity is given as a mean velocity in millimeter/second.

Figure 3:
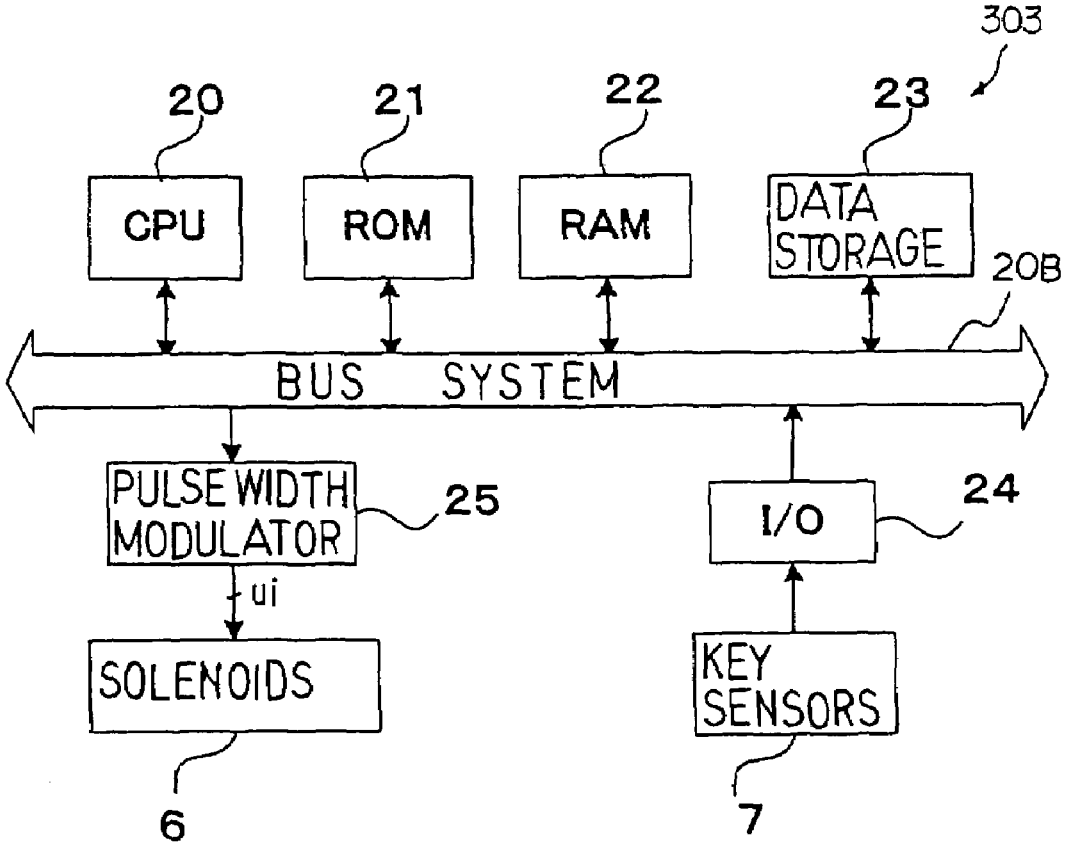
FIG. 3 is a block diagram showing the system configuration of a data processing unit incorporated in the automatic player piano.

Turning to FIG. 3 of the drawings, the data processing unit 303 includes a central processing unit 20, which is abbreviated as "CPU", a read only memory 21, which is abbreviated as "ROM", a random access memory 22, which is abbreviated as "RAM", a data storage 23, an interface 24, which is abbreviated as "I/O", a pulse width modulator 25 and shared bus system 20B. The central processing unit 20, read only memory 21, random access memory 22, data storage 23, interface 24 and pulse width modulator 25 are connected to the shared bus system 20B so that the central processing unit 20 is communicable with the read only memory 21, random access memory 22, data storage 23, interface 24 and pulse width modulator 25 through the shared bus system 20B.

A microprocessor may serve as the central processing unit 20. A computer program, which includes a main routine program and subroutine programs, and parameter tables are stored in the read only memory 21 together with a set of reference tables, two sets of velocity conversion tables and a timing table for tone generation, and the random access memory 22 serves as a working memory. The random access memory 22 offers a temporary data storage to the central processing unit 20, and the set of playback tables is transferred from the data storage 23 to the random access memory 22.

The timing table for tone generation expresses a relation between the hammer velocity and the timing at which the strings 4 are struck with the hammers 3. On the other hand, the set of reference tables expresses relations between the target values of hammer velocity immediately before the strike at the strings 4 and target values of reference key velocity for all the eighty-eight black and white keys 1*a*/1*b*, and the manufacturer prepares the set of reference tables through experiments carried in his manufacturing factory. As described hereinbefore, one of the particular features of the present invention is directed to how the set of playback tables is prepared, and a method for preparing the set of playback tables will be hereinlater described in detail.

In this instance, the two sets of velocity conversion tables are selectively accessed by the central processing unit 20 depending upon the mode of operation. The set of velocity conversion tables used in the recording mode and another set of velocity conversion tables used in the playback mode are hereinafter referred to as "velocity conversion tables for fingered keys" and "velocity conversion tables for actuated keys". This is because of the fact that the black and white keys 1*a*/1*b* behave differently between the manual performance in the recording mode and the automatic playing in the playback mode.

The set of velocity conversion tables for fingered keys and set of velocity conversion tables for actuated keys are prepared for the electronic system 300 by the manufacturer in the manufacturing factory. In detail, the manufacturer has a master automatic player piano in his manufacturing factory, and the master automatic player piano is equipped with not only the key sensors but also hammer sensors. In other words, it is possible actually to measure the reference key velocity and hammer velocity.

Pieces of key data and pieces of hammer data are gathered in the master automatic player piano, and the set of velocity conversion table for fingered keys and set of velocity conversion table for actuated keys are prepared as follows.

Description is firstly made on how the set of velocity conversion table for fingered keys is prepared. When an operator depresses a key, the key sensor supplies pieces of key data representative of the current key position, and the hammer sensor supplies pieces of hammer data representative of the current hammer position or hammer motion, which the depressed key gives rise to. The operator repeats the above-described experiment at different values of key velocity for each of the black and white keys. Upon completion of the experiment, a set of values of hammer velocity is correlated with a set of values of key velocity at the reference key point for each black/white key of the master automatic player piano. The experiment is repeated for all the black and white keys, and the set of velocity conversion tables is obtained for all the black and white keys. This is the set of velocity conversion tables for fingered keys.

Subsequently, the operator instructs the electronic system of the master automatic player piano to drive the black and white keys at a target value of reference key velocity, and gathers pieces of key data and pieces of hammer data through the key sensors and hammer sensors for the black and white keys. The experiment is repeated for the black and white key at other target values of reference key velocity, and the measured values of hammer velocity are correlated with the measured values of reference key velocity. Term "measured value of reference key velocity" means a value of key velocity at the reference key point on the reference key trajectory determined on the basis of the pieces of key data around the reference key point. The relation between the measured values of hammer velocity and the measured values of reference key velocity is tabled as the other set of velocity conversion tables for actuated keys.

The manufacturer further prepares the set of reference tables through experiments. The manufacturer instructs the data processing unit of the master automatic player piano to adjust the black and white keys to target values of reference key velocity at the reference key points on the respective reference key trajectories through the servo-control loop. The driving signal is sequentially supplied from the pulse width modulator to the solenoid-operated key actuators, and the black and white keys are accelerated and decelerated through the servo-control loop with the driving signal. The actuated keys gives rise to the hammer motion, and the hammer sensors supply the hammer position signal to the data processing unit. The measured values of the hammer velocity are determined on the basis of the pieces of hammer data, and is correlated with the target values of reference key velocity. The experiment is repeated at different target values of reference key velocity, and the relation between the target values of reference key velocity and the measured values of the hammer velocity is determined. Thus, the set of reference tables is prepared for all the black and white keys through the experiments.

Although the tables are stored in the read only memory 21 in the non-volatile manner in the electronic system 300, the tables may be stored in the data storage 23 so as to be transferred to the random access memory 22 through a system initialization in a main routine program. While electric power is being supplied to the data processing unit 303, the central processing unit 20 reiterates the main routine program in order to communicate with users, and the main routine program selectively branches into subroutine programs depending upon user's instruction.

The data storage 23 has a huge data holding capacity, and sets of music data codes, which represent pieces of music, are stored therein. The sets of music data codes are prepared for the playback through the performance on the keyboard 1 in the recording mode. Otherwise, the sets of music data codes are loaded into the data storage 23 through a portable information storage medium or a communication network. In this instance, the data storage 23 is implemented by a hard disk driver unit. The data storage 23 retains the above-described tables without any electric power.

The interface 24 includes analog-to-digital converters, and the key sensors 7 are connected to the analog-to-digital converters. The key position signals yxa are supplied to the analog-to-digital converters, and are converted to digital key position signals. The central processing unit 20 periodically fetches the pieces of key data expressed by the digital key position signals, and memorizes the pieces of key data in the random access memory 22. A software timer gives the timing at which the key data is fetched to the central processing unit 20. The central processing unit 20 analyzes the series of key data so as to determine the current key status for each of the black and white keys 1*a*/1*b*.

The pulse width modulator 25 is responsive to a control signal, which is supplied from the central processing unit 20, so as to adjust the driving pulse signal ui to a value of mean current or a given duty ratio, and supplies the driving signal ui to the solenoid 9*b* for the black/white key 1*a*/1*b* to be actuated.

Although other system components such as a switches, indicators and display window are not shown in FIG. 3, these system components are connected to the interface 24, and the user communicates with the central processing unit 20 through those system components. However, any hammer sensor is not incorporated in the electronic system 300 so that the automatic player piano according to the present invention is categorized in the hammer sensorless automatic player piano.

Assuming now that a user instructs the electronic system to reenact his or her performance, the central processing unit 20 transfers the set of music data codes representative of the performance from the data storage 23 to the random access memory 22, and sequentially reads out the music data codes from the random access memory 23. The music data codes express note-on events, note-off events, lapse of time between the previous note-on event/previous note-off event and the present note-on event/present note-off event and other messages.

When the central processing unit 20 receives the music data code expressing the note-on event, the central processing unit 20 determines the black/white key 1*a*/1*b* to be actuated, timing at which the black/white key 1*a*/1*b* starts toward the end position, a reference key trajectory for the black/white key 1*a*/1*b* and a target value of reference key velocity. Since the music data code gives the target loudness, i.e., a target value of hammer velocity to the central processing unit 20, the central processing unit 20 accesses the set of playback tables so as to determine the target value of reference key velocity. The function is expressed as "preliminary data processor" in FIG. 2. If the black/white key 1*a*/1*b* exactly travels on the reference key trajectory, the black/white key 1*a*/1*b* passes through the reference key point at the target value of reference key velocity, and the string 4 is struck with the hammer 3 at the target value of the hammer velocity so that the acoustic piano tone is produced at the target loudness. The method for determining the reference key trajectory is disclosed in Japanese Patent Application laid-open No. Hei 7-175472 as described in conjunction with the related art. In the following description, the black/white keys 1*a*/1*b* are assumed to take uniform motion on the reference key trajectory.

When the central processing unit 20 determines the target value of reference key velocity and reference key trajectory through the function as the preliminary data processor 10, the central processing unit 20 determines a target value of the mean current to be required for bringing the black/white key 1*a*/1*b* to the first value of the key position on the reference key trajectory, and supplies a control signal rf expressing a value of the mean current to the pulse width modulator 25. The pulse width modulator 25 adjusts the driving pulse signal ui to the value of the mean current, and supplies the driving signal ui to the solenoid 9*b* associated with the black/white keys 1*a*/1*b* to be actuated.

When the driving pulse signal ui flows through the solenoid 9*b*, the solenoid 9*b* creates the magnetic field, and the magnetic force, which is proportional to the value of mean current, is exerted on the plunger 9*a*. The plunger 9*a* upwardly projects from the solenoid 9*b*, and pushes the rear portion of the black/white key 1*a*/1*b*. The front portion of the black/white key 1*a*/1*b* is slightly sunk, and the key sensor 7 reports the current key position to the data processor 20 through the key position signal yxa.

The central processing unit 20 compares the target value of the key position target value of key velocity with the measured value of the current key position and measured value of key velocity to see whether or not the black/white key 1*a*/1*b* exactly travels on the reference key trajectory. If the answer is given affirmative, the central processing unit 20 requests the pulse width modulator 25 to keep the driving pulse signal ui at the value of the mean current. On the other hand, if the answer is given negative, the central processing unit 20 determines a new value of the mean current to be required for bringing the black/white key 1*a*/1*b* to the next value of the key position on the reference key trajectory, and informs the pulse width modulator 25 of the new value of mean current. The pulse width modulator 25 increases or decreases the mean current so that the black/white key 1*a*/1*b* is accelerated or decelerated. Thus, the central processing unit 20, pulse width modulator 25, solenoid-operated key actuator 6 and key sensor 7 form the servo control loop.

The central processing unit 20 repeats the above-described control sequence for the black/white keys 1*a*/1*b* to be actuated so that the acoustic piano tones are sequentially produced along the music passage without any fingering of a human pianist.

In order to exactly control the black keys 1*a* and white keys 1*b* in the playback mode, it is necessary to make the relation between the target values of hammer velocity and the target values of key velocity clear.

The relation between the measured values of hammer velocity and the measured values of key velocity is retained in the set of velocity conversion tables for actuated keys, and the relation between the target values of reference key velocity and the measured values of hammer velocity is described in the reference table. The set of playback tables is prepared partially through the study with reference to the set of velocity conversion tables for actuated keys and partially through the transcription from the reference table, and both are free from the undesirable influences of the unstable motion. For this reason, the automatic player 302 according to the present invention can exactly reproduce the acoustic piano tones in the playback mode with the assistance of the playback table. Description is focused on how the set of playback tables is prepared.

Playback Table

Figure 4:
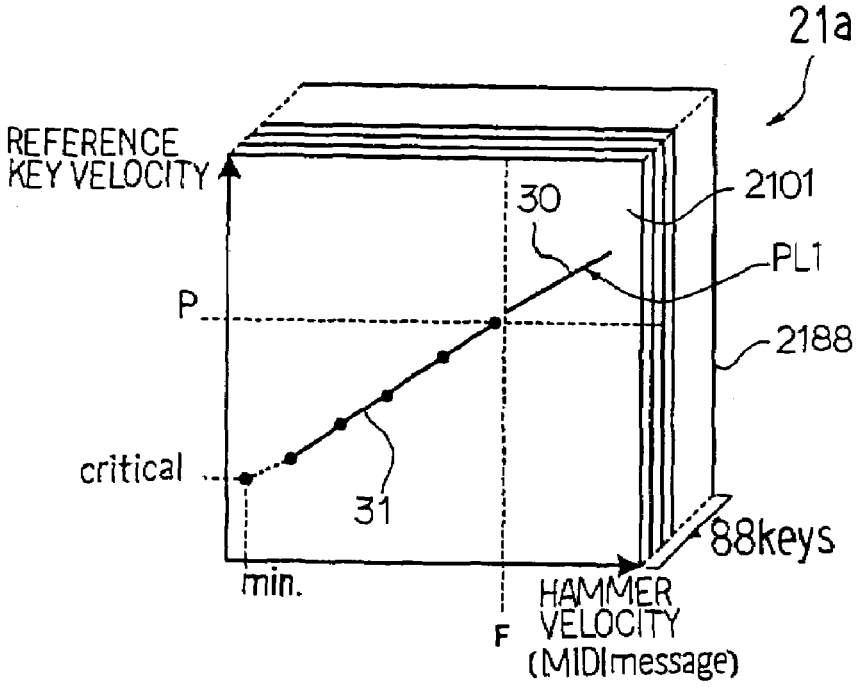
FIG. 4 is a view showing a concept of a playback table.

FIG. 4 illustrates the concept of the set of playback table. The set of playback tables is designated by reference 21*a*, and has a three-dimensional structure. The set of playback tables 21*a* includes eighty-eight tables or eighty-eight data blocks, which are respectively corresponding to the eight-eight black and white keys 1*a*/1*b*. The first data block, which is assigned to the white key 1*b* at the lowest pitched tone, is labeled with 2101, and the last data block, which is assigned to the white key 1*b* at the highest pitched tone, is labeled with reference 2188. Since the eight-eight data blocks 2101 to 2188 are similar in structure to one another, description is focused on the first data block 2101 or the first playback table.

In the data block 2101, the target values of hammer velocity, which is incorporated in the MIDI message, are correlated with the target values of reference key velocity, and the relation between the hammer velocity and the reference key velocity is indicated by plots PL1. The plots PL1 is broken down into two parts, i.e., a high-speed region 30 and a low-to-medium speed region 31. The critical target value hammer velocity F is at the boundary between the high-speed region 30 and the low-to-medium speed region 31. When the black and white keys 1*a*/1*b* give rise to the hammer motion at a target value of hammer velocity is equal to or less than the critical value of hammer velocity F, the key motion is fairly stable, and the undesirable influence is ignoreable. However, if the hammer 3 exceeds the critical value F of hammer velocity F, the key motion becomes unstable, and the key velocity, which is measured by the key sensor 7, is less reliable. For this reason, the data files 2101 to 2188 are partially prepared through the study and partially transcribed from the set of reference tables.

Figure 5A:
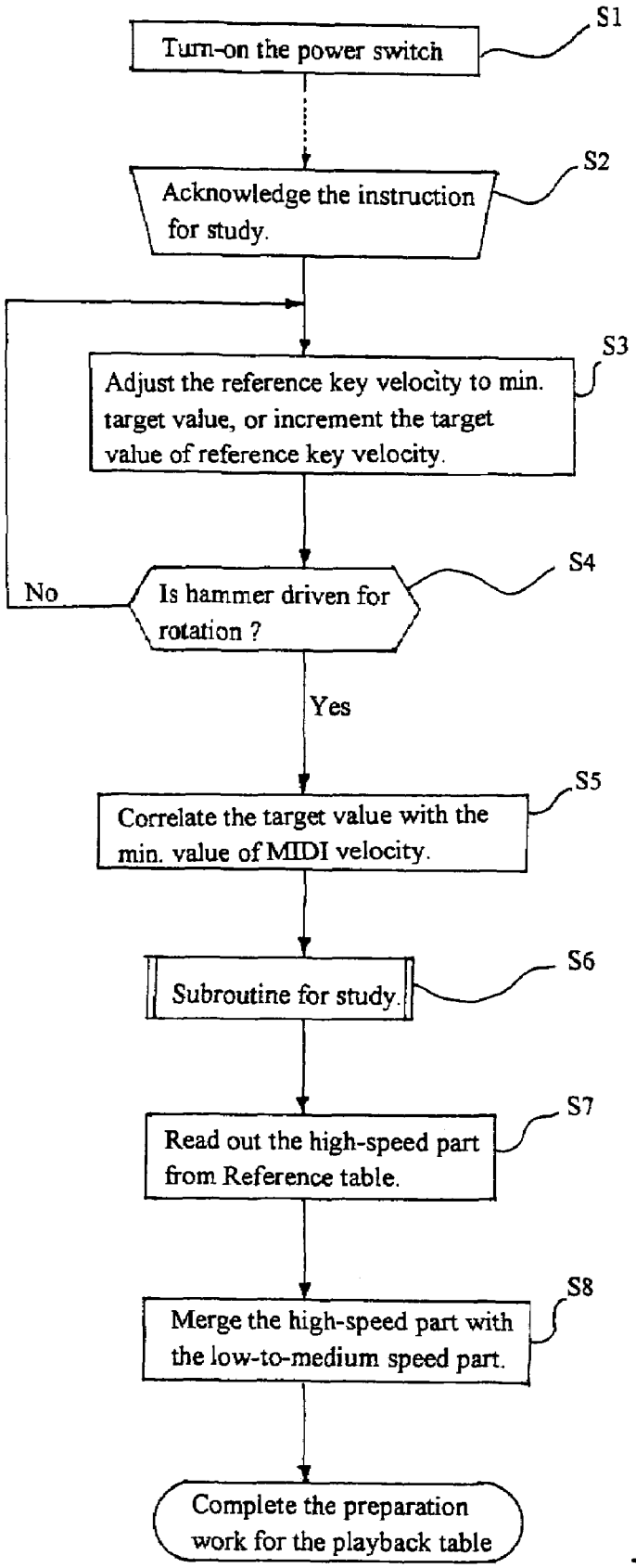
FIG. 5A is a flowchart showing a part of a computer program for preparing the playback table.
Figure 5B:
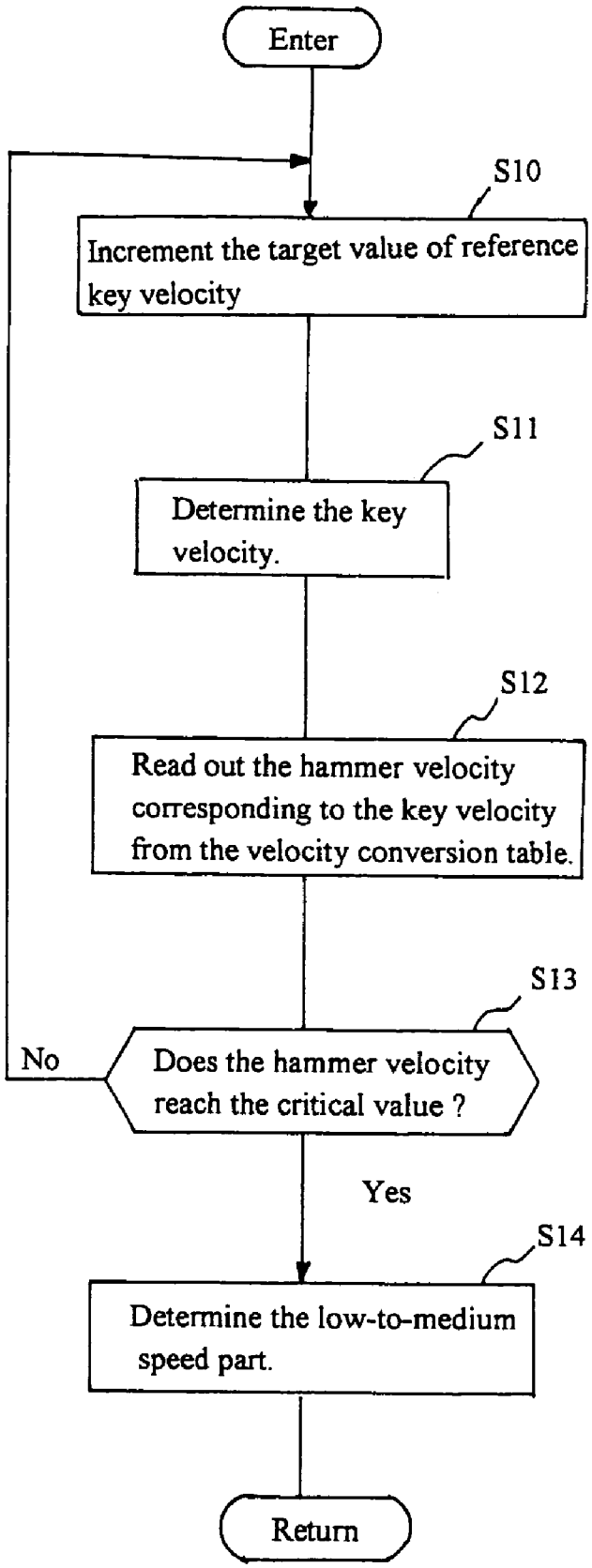
FIG. 5B is a flowchart showing a subroutine program for preparing a low-to-medium speed part of the playback table.

A computer program runs on the central processing unit 20, and the set of playback tables 21*a* is prepared in a part of the initialization of the electronic system 300. FIGS. 5A and 5B shows a part of the computer program executed for preparing the set of playback tables. Although the central processing unit 20 repeats steps S3, S4, S5, S6, S7 and S8 eighty-eight times for the eighty-eight black and white keys 1*a*/1*b*, description is made on one of the black/white keys 1*a*/1*b* for the sake of simplicity.

Assuming now that a user turns on the power switch as by step S1, the computer program starts to run on the central processing unit 20, and firstly initializes the electronic system 300. If the user instructs the central processing unit 20 to prepare the set of playback table, the central processing unit 20 acknowledges the user's instruction as by step S2, and determines a critical value of the mean current at which the hammer is driven for the free rotation as by steps S3 and S4. The user gives the instruction at step S2 to the central processing unit 20 when workers complete a repairing work or a maintenance work on the automatic player piano.

In detail, the central processing unit 20 instructs the servo-control loop to adjust black/white key 1*a*/1*b* to the minimum target value of the reference key velocity. The pulse with modulator 25 adjusts the driving pulse signal ui to a certain value, and supplies the driving pulse signal ui to the solenoid 9*b* of the associated solenoid-operated key actuator 6. Then, the plunger 9*a* upwardly projects from the solenoid 9*b*, and pushes the rear portion of the black/white key 1*a*/1*b*. The front portion of the black/white key 1*a*/1*b* is sunk, and makes the current key position varied with time. The servo-control loop makes the black/white key 1*a*/1*b* pass the reference key point at the target value of reference key velocity as by step S3.

Figure 7:
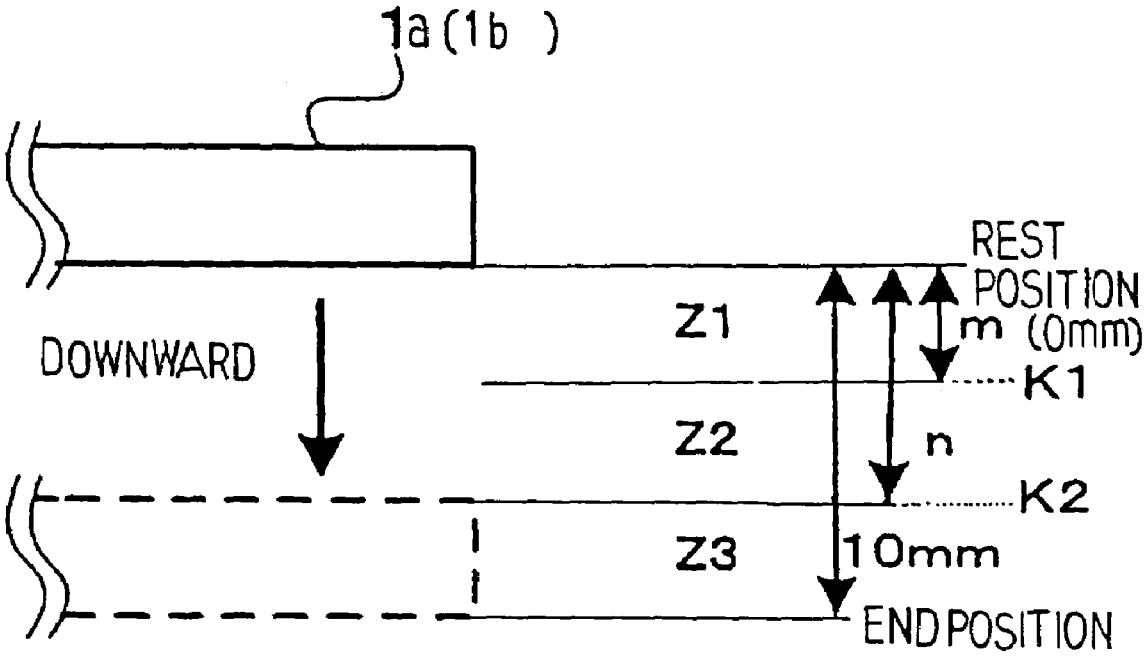
FIG. 7 is a schematic view showing zones defined between the rest position and the end position.

Subsequently, the central processing unit 20 checks the key position signal to see whether or not the action unit 2 gives rise to the rotation of the hammer 3 as by step S4. If the plunger 9*b* exerts the force large enough to make the hammer 3 escape from the jack 2*a* on the rear portion of the black/white key 1*a*/1*b*, the hammer 3 starts the free rotation, and the string 4 is struck with the hammer 3. The string 4 generates the acoustic piano tone. If, on the other hand, the force is too small, the hammer 3 can not escape from the jack 2*a*, and any acoustic piano tone is not generated. The central processing unit 20 presumes the string 4 to be struck with the hammer 3 on the basis of the pieces of key data. As will be described in conjunction with FIG. 7, if the pieces of key data exhibit that the black/white key 1*a*/1*b* exceeds a threshold K2, the positive answer "Yes" is given to the central processing unit 20. If, on the other hand, not, the negative answer "No" is given to the central processing unit 20. Since the driving pulse signal has been adjusted to the minimum value of the mean current, the force is so small that the hammer 3 can not escape from the jack 2*a*. This results in the negative answer "No" at step S4. The method for the presumption has been already known to the skilled persons.

With the negative answer, the central processing unit 20 returns to step S3, and instructs the servo-control loop to increment the target value of reference key velocity. The pulse width modulator 25 supplies the driving signal ui to the solenoid 9*b*, and the solenoid-operated key actuator 6 gives rise to the key motion, again. The servo-control loop makes the black/white key 1*a*/1*b* obtain the next value of reference key trajectory, and the central processing unit 20 checks the key position signal to see whether or not the black/white key 1*a*/1*b* gives rise to the rotation of the associated hammer 3 at step S4. Thus, the central processing unit 20 reiterates the loop consisting of steps S3 and S4 until the answer at step S4 is changed to affirmative.

The hammer 3 is assumed to escape from the jack 2*a* at a certain target value of reference key velocity. The answer at step S4 is changed to affirmative. With the positive answer "Yes", the central processing unit 20 proceeds to step S5, and stores the certain target value in the working memory 22. The minimum value of velocity defined in the MIDI message has been already known. Then, the central processing unit 20 correlates the certain target value of reference key velocity with the minimum value of MIDI velocity, which is corresponding to the minimum value of the hammer velocity.

Upon completion of the job at step S5, the central processing unit 20 enters a subroutine program for the study as by step S6. The sequence of the subroutine program is shown in FIG. 5B, and is hereinafter described in detail.

Upon entry into the subroutine program, the central processing unit 20 increments the reference key velocity to the next target value as by step S10. In the first execution at step S6, the reference key velocity is increased from the minimum target value to the next target value. It is not necessary that the increment is corresponding to the highest resolution. The hammer velocity may be stepwise increased five times between the minimum value to the critical value F. When the target value of the hammer velocity is found between one of the five points and another of the five points in the playback, the central processing unit 20 determines the target reference key velocity through the interpolation. Thus, the interpolation is desirable, because the load on the central processing unit 20 in the study is reduced.

The central processing unit 20 requests the servo-control loop to make the black/white key 1*a*/1*b* pass through the reference key point at the next value of the reference key velocity. The servo-control loop adjusts the black/white key 1*a*/1*b* to the next value of reference key velocity at the reference key point. The force is transmitted from the black/white key 1*a*/1*b* through the action unit 2 to the hammer 3, and the string 4 is struck with the hammer 3 at the end of the free rotation.

In this situation, the key sensor 7 reports the key motion to the central processing unit 20 through the key position signal yxa, and the central processing unit 20 determines the measured value of key velocity as by step S11. With the measured value of key velocity, the central processing unit 20 accesses the velocity conversion table for solenoids, and reads out the corresponding value of the hammer velocity from the velocity conversion table for solenoids as by step S12. The central processing unit 20 correlates the read-out value of hammer velocity with the target value of reference key velocity, and stores them in the random access memory 22.

Subsequently, the central processing unit 20 compares the read-out value of hammer velocity with the critical value F to see whether or not the study work reaches the boundary between the low-and-medium speed part and the high speed part as by step S13. While the answer at step S13 is given negative "No", the central processing unit 20 reiterates the loop consisting of steps S10 to S13, and accumulates the corresponding values of hammer velocity correlated with the target values of reference key velocity in the random access memory 22.

When the central processing unit 20 finds the read-out value of hammer velocity equal to the critical value F, the central processing unit 20 completes the "study". In other words, the central processing unit 20 determines the low-to-medium speed part as by step S14, and stores the relation in the low-to-medium speed part in the random access memory 22. Thereafter, the central processing unit 20 returns to the main routine, and proceeds to step S7.

In step S7, the central processing unit 20 accesses one of the reference tables, and reads out the high-speed part from the reference table. The central processing unit 20 stores the high-speed part in the random access memory 22, and merges the high-speed part with the low-to-medium speed part as by step S8. Thus, the central processing unit 20 completes plots PL1 for one of the eighty-eight keys 1*a*/1*b*.

It may be rare that the rightmost value on the low-to-medium speed part is equal to the leftmost value of the high-speed part. This means that the low-to-medium speed part has to be connected to the high-speed part through a suitable merging technique. There are some candidates. The first candidate is the interpolation. Values are interpolated between the rightmost value "P" (see FIG. 4) and the leftmost value of the high-speed part. The second candidate is to prepare several reference tables different in pattern. The central processing unit 20 selects the optimum reference table from them, and connects the low-to-medium speed part to the high-speed part read out from the optimum table. The third candidate is to modify the reference table. The modification may be carried out through a parallel displacement of the high-speed part or rotation of the high-speed part about the greatest value.

The central processing unit 20 repeats the above-described sequence eighty-eight times, and completes the set of playback tables 21*a* for the eighty-eight keys 1*a*/1*b*. Since the set of reference tables has been also prepared for the eighty-eight black/white key 1*a*/1*b*, the central processing unit 20 accesses different reference tables at step S7.

As will be understood, the playback table is prepared on the basis of the study, and the result of the study is merged with the part of the reference table. The set of reference tables is prepared through the experiences on the master automatic player piano, and the influence of unstable key motion is taken into account. In other words, the solenoid-operated key actuators 6 are expected to give rise to the hammer motion under the condition of the relation between the target values of reference key velocity and the measured values of hammer velocity. Thus, the playback table according to the present invention permits the hammer sensor-less automatic player piano exactly to reproduce the original hammer motion in the playback mode.

In FIG. 5B, the hammer velocity is determined through the execution at step S11. The job at step S11 is realized through an instruction sequence shown in FIG. 6. Although the instruction sequence is prepared on the assumption that the black and white keys 1*a*/1*b* is downwardly moved, it is possible to prepare an instruction sequence for the upward key motion in a similar manner to the instruction sequence for the downward key motion.

Figure 6:
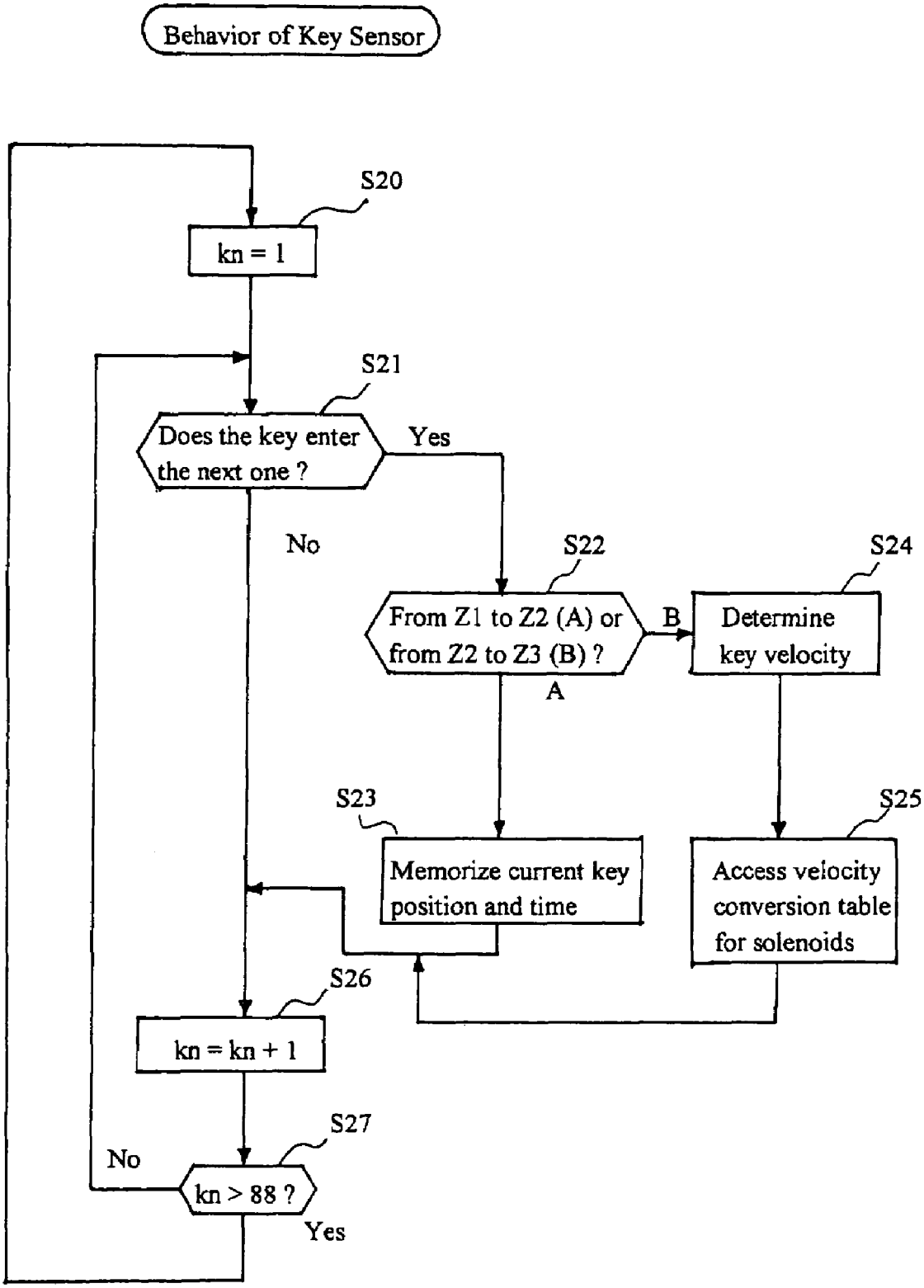
FIG. 6 is a flowchart showing an instruction sequence for determining the hammer velocity.

The central processing unit 20 periodically enters the instruction sequence, and repeats the loop consisting of steps S21 to S27 for the eighty-eight keys 1*a*/1*b*. Key numbers are respectively assigned to the black and white keys 1*a*/1*b*, and is expressed as "kn". Of course, the instruction sequence is available for determination of the hammer velocity in the playback mode. While a black/white key 1*a*/1*b* is moving downwardly from the rest position to the end position, the black/white key 1*a*/1*b* passes through three zones Z1, Z2 and Z3 as shown in FIG. 6, and the boundary between the zones Z1 and Z2 and boundary between the zones Z2 and Z3 are aligned with the values K1 and K2 of current key position, and the current key positions K1 and K2 are at stroke m and stroke n, respectively. The stroke is measured from the lower surface at the rest position to the lower surface of the current key position. The values K1 and K2 of current key position serve as thresholds.

Firstly, the central processing unit 20 sets "1" as kn as by step S20. The central processing unit 20 compares the latest value of current key position with the previous value of current key position and the thresholds K1 and K2 to see whether or not the black/white key 1*a*/1*b*, which is assigned the key number kn, proceeds to the next zone Z2 or Z3 as by step S21. If the white key 1*b* still stays in the zone Z1, Z2 or Z3 from the previous execution to the present execution, the answer is given negative "No". With the negative answer "No", the central processing unit 20 increments kn by one as by step S26, and compares the key number kn with 88 to see whether or not kn is greater than 88 as by step S27. While the central processing unit 20 is investigating the leftmost white key 1*b* and the white key on the left side of the rightmost white key 1*b*, the answer at step S27 is given negative "No", and the central processing unit 20 returns to step S21. Thus, the central processing unit 20 reiterates the loop consisting of steps S21, S26 and S27, and looks for a black key/white key 1*a*/1*b* entering the next zone Z2 or Z3 across the threshold K1 or K2.

The central processing unit 20 is assumed to find a black/white key 1*a*/1*b* to enter the next zone Z2 or Z3. The answer at step S21 is changed to the affirmative "Yes", and the central processing unit 20 checks the comparison result to see whether the black/white key 1*a*/1*b* proceeds from the zone Z1 to the zone Z2 or from the zone Z2 to the zone Z3 as by step S22. When the black/white key 1*a*/1*b* entered the zone Z2, the central processing unit 20 adopts course "A", and checks the software timer for determining the time so as to memorize the time together with the key position in the random access memory 22 as by step S23. Upon completion of the jobs at step S23, the central processing unit 20 proceeds to step S26, and returns to the loop. The current key position is used in step S21 in the next execution.

If, on the other hand, the black/white key 1*a*/1*b* entered the next zone Z3, the central processing unit 20 acknowledges that the black/white key 1*a*/1*b* have given rise to the free rotation of the hammer 3, and adopts course "B". The course "B" leads the central processing unit 20 to step S24, and the central processing unit 20 determines the key velocity at step S24. In detail, the central processing unit 20 determines the current key position and the time, and respectively subtracts the value of current key position and time from the previous value and time, which were memorized at step S23 in the previous execution. The difference between the values of current key position is divided by the difference between the previous time and the present time, and determines the mean value of the key velocity.

Subsequently, the central processing unit 20 accesses the velocity conversion table for solenoids, and reads out a value of hammer velocity corresponding to the mean value of the key velocity as by step S25. Upon completion of the jobs at step S25, the central processing unit proceeds to step S26. Thus, the central processing unit 20 reiterates the loop consisting of steps S20 to S27 for determining the hammer velocity on the basis of the key velocity.

When the central processing unit investigated the eighty-eighth key 1*b*, the answer at step S27 is changed to affirmative, and the central processing unit 20 returns to step S20, and resets the key number kn to 1. In other words, the central processing unit 20 repeatedly executes the program sequence shown in FIG. 5, and determines the hammer velocity on the basis of the key velocity.

As will be understood, the set of playback tables 21*a* is prepared partially through the study and partially through the transcription from the set of reference tables to the high-speed part. Since the measured values of the hammer velocity are exactly correlated with the target values of reference key velocity in the set of reference tables, the set of playback tables is free from the undesirable influence of unstable key motion. The central processing unit 20 looks up the playback table so as to determine the target value of reference key velocity on the basis of the target value of hammer velocity. Even if a MIDI data code requests the automatic player 302 to produce an acoustic piano tone at large loudness, the automatic player 302 can exactly reproduce the hammer motion through the associated black/white key 1*a*/1*b*, and the acoustic piano tone is exactly reproduced at the loudness equal to that of the original acoustic piano tone.

Recording

Figure 8:
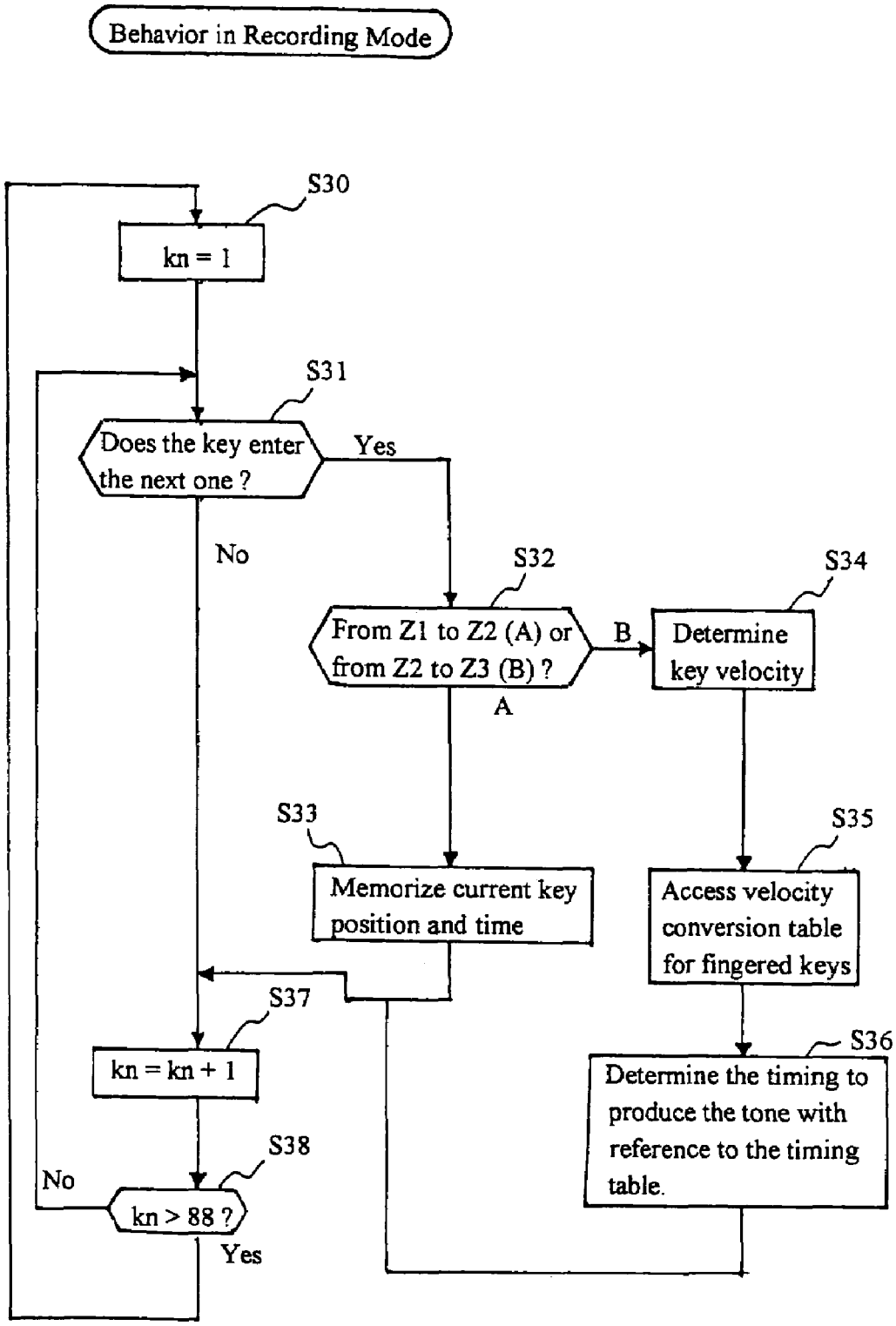
FIG. 8 is a flowchart showing a part of a subroutine program for recording.
Figures 9, 10:
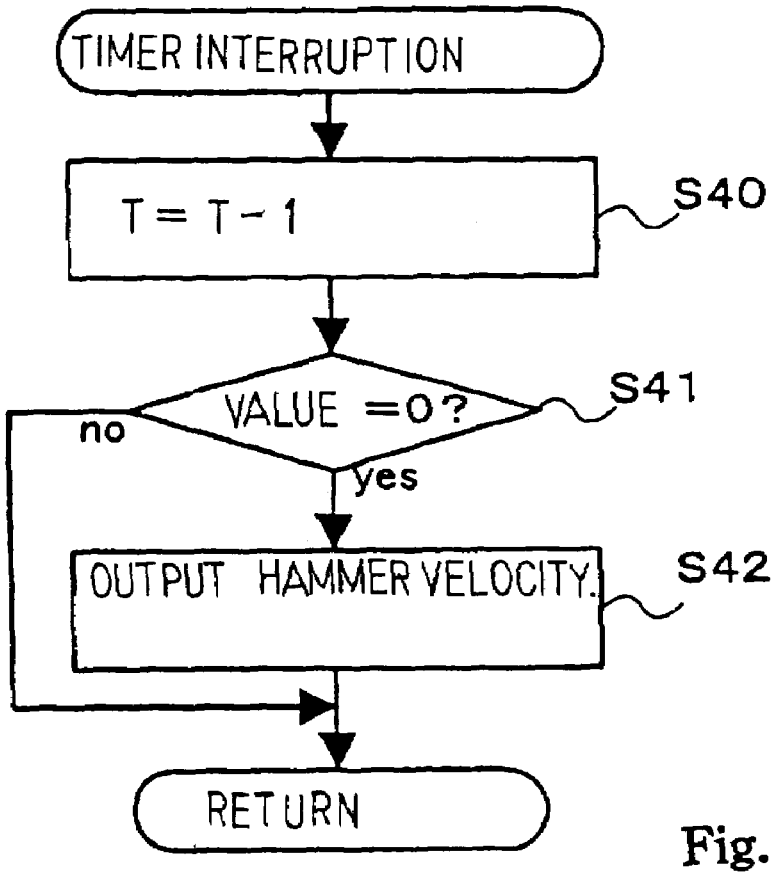
FIG. 9 is a view showing pieces of hammer data paired with pieces of timing data.
FIG. 10 is a flowchart showing a count-down program.

Description is hereinafter made on a sequence of jobs during recording with reference to FIGS. 8, 9 and 10. Firstly, the central processing unit 20 sets "1" as kn as by step S30. The index "kn" is indicative of the black key 1*a* or white key 1*b*, and is varied between 1 and 88. The central processing unit 20 compares the latest value of current key position with the previous value of current key position and the thresholds K1 and K2 to see whether or not the white key 1*b*, which is assigned the key number kn, proceeds to the next zone Z2 or Z3 as by step S31. If the white key 1*b* still stays in the zone Z1, Z2 or Z3 from the previous execution to the present execution, the answer is given negative "No". With the negative answer "No", the central processing unit 20 increments kn by one as by step S37, and compares the key number kn with 88 to see whether or not kn is greater than 88 as by step S38. While the central processing unit 20 is investigating the leftmost white key 1*b* and the white key on the left side of the rightmost white key 1*b*, the answer at step S38 is given negative "No", and the central processing unit 20 returns to step S31. Thus, the central processing unit 20 reiterates the loop consisting of steps S31, S37 and S38, and looks for a black key/white key 1*a*/1*b* entering the next zone Z2 or Z3 across the threshold K1 or K2.

The central processing unit 20 is assumed to find a black/white key 1*a*/1*b* to enter the next zone Z2 or Z3. The answer at step S31 is changed to the affirmative "Yes", and the central processing unit 20 checks the comparison result to see whether the black/white key 1*a*/1*b* proceeds from the zone Z1 to the zone Z2 or from the zone Z2 to the zone Z3 as by step S32. When the black/white key 1*a*/1*b* entered the zone Z2, the central processing unit 20 adopts course "A", and checks the software timer for determining the time so as to memorize the time together with the key position in the random access memory 22 as by step S33. Upon completion of the jobs at step S33, the central processing unit 20 proceeds to step S37, and returns to the loop. The current key position is used in step S31 in the next execution.

If, on the other hand, the black/white key 1*a*/1*b* entered the next zone Z3, the central processing unit 20 acknowledges that the black/white key 1*a*/1*b* have given rise to the free rotation of the hammer 3, and adopts course "B". The course "B" leads the central processing unit 20 to step S34, and the central processing unit 20 determines the key velocity.

Subsequently, the central processing unit 20 accesses the velocity conversion table for fingered keys, and reads out a value of hammer velocity corresponding to the mean value of the key velocity as by step S35. Upon completion of the jobs at step S35, the central processing unit 20 proceeds to step S36, and accesses the timing table so as to determine the timing to produce the acoustic piano tone. Pieces of timing data are correlated with the values of hammer velocity in the timing table. The timing data is indicative of a lapse of time from the transit at K2 to the initiation of tone generation, and the unit is millisecond.

The central processing unit 20 makes pieces of hammer data representative of the values of hammer velocity Velo1, Velo2, Velo3, . . . . Velo 16, which are corresponding to the pieces of velocity data defined in the MIDI protocols, paired with the pieces of timing data T1, T2, T3, . . . and T16 as shown in FIG. 9, and memorizes the value of hammer velocity and timing to produce the acoustic piano tone together with the key number kn in the random access memory 22. It is possible to concurrently produce sixteen pieces of paired data at the maximum. Upon completion of the memorization, the central processing unit 20 returns to the loop consisting of steps S31, S37 and S38. Thus, the central processing unit 20 reiterates the loop consisting of steps S31 to S38 so as to obtain the pieces of music data.

When the central processing unit 20 investigated the eighty-eighth key 1*b*, the answer at step S38 is changed to affirmative, and the central processing unit 20 returns to step S30, and resets the key number kn to 1. As described hereinbefore, the central processing unit 20 repeatedly executes the program sequence shown in FIG. 8, and produces the pieces of music data representative of the performance on the keyboard 1.

The pieces of music data are normalized, and are encoded to the MIDI music data codes. When the performance on the keyboard 1 is terminated at a certain tone, the user instructs the central processing unit 20 to transfer a set of MIDI music data codes to the data storage 23. The central processing unit 20 adds the status byte representative of the end of the performance to the MIDI music data codes representative of the tones produced by the user, and transfers the set of MIDI music data codes to the data storage 23, an external musical instrument through a MIDI cable or an external data storage through a communication network.

Thus, the central processing unit 20 estimates the hammer velocity by using the velocity conversion table for fingered keys, and produces the MIDI music data codes representative of the performance.

Preparation of Duration Data

The MIDI music data codes representative of the note-on events and note-off events are accompanied with duration codes. Each of the duration codes is indicative of the lapse of time from the previous event. As described hereinbefore, the central processing unit 20 acknowledges the note-on events at the time when the black/white keys 1*a*/1*b* reach the current key positions K2, and determines the hammer velocity for the note-on events. However, the time interval between the transit at K2 and the strike at the strings 4 is varied depending upon the hammer velocity. In order to exactly determine the timing at which the tones are to be reproduced, the central processing unit 20 executes a count-down subroutine shown in FIG. 10 before preparation of the duration codes.

While the central processing unit 20 is preparing a set of MIDI music data codes and associated duration data codes through the subroutine program for recording, a timer interruption takes place at regular intervals of 1 millisecond, and the subroutine program branches to the count-down subroutine for count-down.

The timer interruption is assumed to take place. The subroutine program for the recording branches to the count-down program, and the central processing unit 20 firstly decrements the values of the pieces of timing data T, which stands for all the pieces of timing data T1, T2, . . . , by 1. If sixteen pieces of hammer data Velo 1 to Velo 16 have been paired with the pieces of hammer data as shown in FIG. 8, all the values, which are represented by sixteen pieces of timing data T1 to T16, are decremented by one as by step S40.

Subsequently, the central processing unit 20 checks the pieces of timing data T to see whether or not any one of the values reaches zero as by step S41. If the answer is given negative "no", the central processing unit immediately returns to the subroutine program for the recording.

On the other hand, when the central processing unit 20 finds that one of the pieces of timing data is indicative of zero, the answer at step S41 is given affirmative "yes". Then, the central processing unit 20 supplies the associated piece of hammer data to a register defined in the random access memory 22 as by step S42.

Upon completion of the jobs at step S42, the central processing unit 20 returns to the subroutine program for the recording, and determines the lapse of time from the previous event. The central processing unit encodes the lapse of time in the format defined in the MIDI protocols, and makes the MIDI music data code representative of the note-on event accompanied with the duration code.

As will be understood, while the duration codes are being prepared for the MIDI music data codes representative of the events, the hammer velocity is taken into account. This means that the lapse of time between the events is strictly equal to the lapse of time between the tones produced during the original performance. Thus, the automatic player piano according to the present invention exactly reenacts the original performance.

Playback

Figure 11:
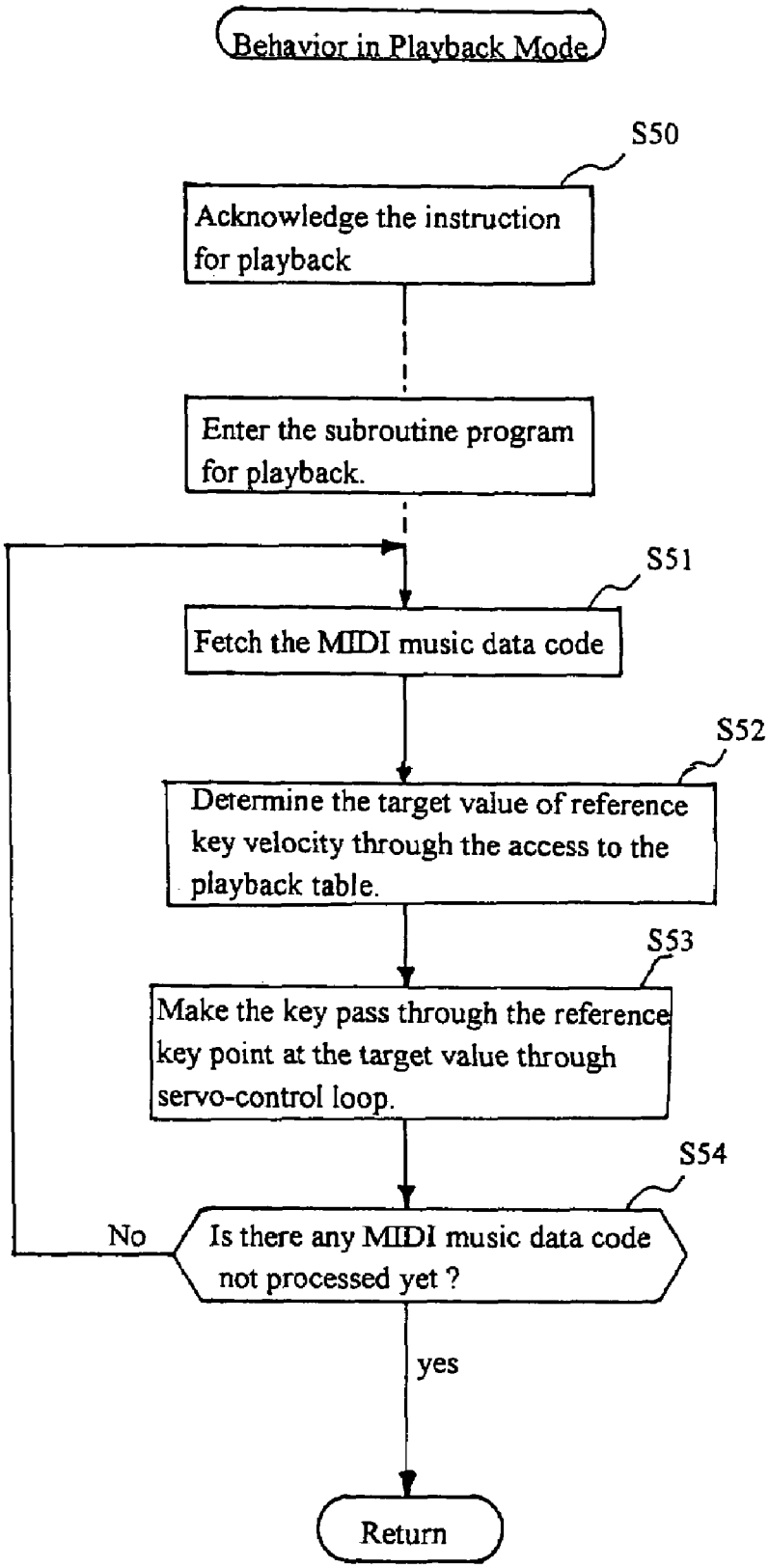
FIG. 11 is a flowchart showing a subroutine program for playback.

While the central processing unit 20 is reiterating the main routine program, the user is assumed to instruct the automatic player 302 to reenact a performance already recorded in the form of MIDI music data codes. The central processing unit 20 acknowledges the instruction for the playback as by step S50 (see FIG. 11). Then, the main routine program branches to the sub-routine program for playback, and the central processing unit 20 transfers the set of MIDI music data codes from the data storage 23 to the random access memory 22.

The central processing unit 20 fetches the MIDI music data code to be firstly processed from the random access memory 22, and specifies the black/white key 1*a*/1*b* to be moved, the hammer velocity or loudness and the timing to produce the tone as by step S51.

Subsequently, the central processing unit 20 accesses one of the playback tables 21*a* corresponding to the black/white key 1*a*/1*b* to be moved, and determines a target value of reference key velocity for the black/white key 1*a*/1*b* and the reference key trajectory as by step S52. The pulse width modulator 25 supplies the driving pulse signal ui to the solenoid 9*b*, and the plunger 9*a* starts to project upwardly.

The solenoid-operated key actuator 6 gives rise to the key motion. While the plunger 9*a* is projecting upwardly, the key sensor 7 reports the current key position to the central processing unit 20, and the central processing unit 20 compares the current key position current key velocity with a target key position and target key velocity on the reference trajectory to see whether or not the black/white key 1*a*/1*b* exactly travels on the reference trajectory. If the answer is given affirmative, the central processing unit 20 instructs the pulse width modulator 25 to keep the driving pulse signal ui at the present value. On the other hand, if the answer is given negative, the central processing unit 20 instructs the pulse width modulator 25 to increment or decrement the mean current, and the pulse width modulator 25 varies the mean current of the driving pulse signal ui. In other words, the central processing unit 20 instructs the servo-control loop to make the black/white key 1*a*/1*b* pass the reference key point at the target value of the reference key velocity, and the pulse width modulator 25 increases, decreases or keep the mean current of the driving pulse signal ui under the control of the central processing unit 20. Thus, the servo-control loop causes the black/white key 1*a*/1*b* to pass the reference key point at the target value of reference key velocity as by step S53.

Subsequently, the central processing unit 20 checks the random access memory 22 to see whether or not a MIDI music data code representative of the event is still left therein as by step S54. When the central processing unit 20 finds the MIDI music data code in the random access memory, the answer is given negative "No", and the central processing unit 20 returns to step S51. Thus, the central processing unit 20 reiterates the loop consisting of steps S51 to S54 for processing the MIDI music data codes. If the central processing unit 20 does not find any MIDI music data code, the answer at step S54 is given negative, and the central processing unit 20 returns to the main routine program.

As will be appreciated from the foregoing description, the automatic player 302 looks up the set of playback tables 21*a*, which was prepared partially through the study and partially through the transcription from the set of reference tables, so as to determine the target value of reference key velocity. The reference table was prepared through the experiment on the master automatic player piano so that the hammer velocity was free from the unstable key motion. For this reason, the automatic player musical instrument according to the present invention exactly reenacts the performance.

Although the particular embodiment of the present invention has been shown and described, it will be apparent to those skilled in the art that various changes and modifications may be made without departing from the spirit and scope of the present invention.

For example, the non-contact optical sensors may be replaced with another sort of sensor such as, for example, a magnetic sensor or a potentiometer. The other sort of sensor may convert velocity or acceleration of the black/white keys 1*a*/1*b* to key velocity signals or key acceleration signals. The position, velocity and acceleration are converted to one another through the differentiation and integration. The functions 12/13 of recorder 301 and functions 10/11 of automatic player may be realized by means of wired logic circuits.

A playback table may be prepared only for the relation below the critical hammer velocity F through the study. In this instance, the central processing unit 20 selectively accesses the playback table and reference table depending upon the result of comparison between the target value of the hammer velocity and the critical hammer velocity.

Another automatic player according to the present invention may have an equation or a set of equations expressing the relation between the target values of hammer velocity and the target values of reference key velocity instead of the playback table.

The critical value P may be common to the products or individually given to the products. In case where the critical values are individually given to the products of hammer sensor-less automatic player piano, the automatic player has a reference table expressing the relation between the measured values of hammer velocity and the target values of reference key velocity, and the central processing unit increases the reference key velocity from zero so as to find the critical value P through the comparison between the corresponding value of hammer velocity determined through the access to the velocity conversion table and the values of hammer velocity in the reference table.

The playback table may be prepared on the basis of the reference table only. In other words, any part of the playback table is not prepared through the study. The playback table, which was prepared without any study, is available for an automatic player without any key sensor.

The read only memory 21 may be implemented by electrically erasable programmable read only memory. In this instance, the read only memory 21 can partially serve as a working memory.

A flexible disk driver unit, a floppy disk (trademark) driver unit, a compact disk driver unit, a photo-electro-magnetic disk driver unit, a ZIP disk driver unit and a DVD (Digital Versatile Disk) driver unit are available for the data storage 23. In case where the tables are stored in the read only memory 21, a RAM board is available for the data storage 23.

The set of reference tables may be replaced with only one reference table or some reference tables. The some reference tables may be assigned to different pitched parts. In case where only one reference table is shared among all the black and white keys 1*a*/1*b*, only one high-speed part may be accessed for all the black and white keys 1*a*/1*b*. In this instance, only a small amount of memory space is occupied by the set of playback tables so that the manufacturer can reduce the data holding capacity of the random access memory 22.

In the above-described embodiment, the keys are assumed to take the uniform motion. The black/white keys 1*a*/1*b* may be assumed to take a uniformly accelerated motion. Even if the black/white keys are assumed to take the uniformly accelerated motion, the reference trajectories are presumable for the keys to be moved, and the solenoid-operated key actuators give rise to the key motion with reference to the playback table.

The acceleration and/or displacement may be taken into account of the servo-control. In this instance, the servo-control is carried out on selected one of ones of the position, velocity and acceleration.

The plots PL1 do not set any limit to the technical scope of the present invention. Another model may have plots different from the plots PL1.

The MIDI protocols do not set any limit to the technical scope of the present invention. Even if an automatic player musical instrument is designed on the basis of another set of musical protocols, the present invention is applicable to the automatic player musical instrument in so far as the loudness of tones are to be controlled on the basis of certain behavior of component parts not directly monitored.

The automatic player piano does not set any limit to the technical scope of the present invention. The present invention is applicable to any sort of automatic player musical instrument fabricated on the basis of another acoustic or hybrid musical instrument such as, for example, a mute piano, a keyboard for practical use, a harpsichord or a celesta. The mute piano is a hybrid keyboard musical instrument, and a hammer stopper and an electronic tone generator are installed in an acoustic piano.

In case where the present invention is applied to the mute piano, the central processing unit also periodically executes the count-down subroutine, and transfers the MIDI music data code, in which the piece of hammer data Velo is stored, to an electronic tone generator when the associated piece of timing data reaches zero.

In case where the high-speed part is shared among plural keys 1*a*/1*b*, the central processing unit 20 compares the value of hammer velocity with the critical value F to see whether the target value of reference key velocity is to be read out from the common high-speed part or from the playback table prepared through the study.

In another embodiment, the key sensors 7 and motion controller 11 are not incorporated in the automatic player, and the driving signal is directly supplied from the preliminary data processor 10 to the solenoid-operated key actuators 6. In other words, any servo-control is not carried out. Thus, the key sensors 7 and servo-control are not indispensable features of the present invention. In this instance, the playback table is prepared through the transcription from the reference table, and the "study" is not carried out.

The computer program may be downloaded from an external program source through a communication network or read out from a portable information storage medium such as, for example, a floppy disk or a compact disk.

The pulse width modulator 25 does not set any limit to the technical scope of the present invention. A voltage regulator may be used for adjusting the potential level of a driving signal to a target value.

The component parts of the automatic player piano are correlated with claim languages as follows. The black keys 1*a* and white keys 1*b* are corresponding to "plural manipulators", and the action units 2, hammers 3 and strings 4 as a whole constitute a "tone generator". The hammers 3 serve as "certain links". The solenoid-operated key actuators 6 serve as "plural actuators", and the driving pulse signal ui is corresponding to a "driving signal". The current key position or stroke from the rest position is corresponding to a "physical quantity". The preliminary data processor 10 and motion controller 11, i.e., the central processing unit 20, read only memory 21, random access memory 22, data storage 23, interface 24, pulse width modulator 25, bus system 20B and computer program as a whole constitute a "data processing unit". The relation defined in the playback table 21*a* is corresponding to a "playback relation".

The key sensors 7 serve as "plural sensors", and key position signals yxa are corresponding to "detecting signals". The velocity conversion table serves as a "velocity converter". The study is corresponding to an "experiment internally carried out".

What is claimed is:

1. An automatic player musical instrument for producing tones without fingering of a human player, comprising:

an acoustic musical instrument including plural manipulators selectively manipulated for specifying the tones to be produced, and a tone generator having certain links connected to said plural manipulators and responsive to motion of the manipulated manipulators for producing said tones through motion of the certain links connected to said manipulated manipulators; and an automatic player including plural actuators respectively associated with said plural manipulators and responsive to a driving signal so as to give rise to said motion of said manipulated manipulators along reference trajectories, reference velocity of said manipulated manipulators at respective reference points on said reference trajectories being proportional to velocity of the associated certain links which in turn is proportional to loudness of said tones produced through said tone generator and a data processing unit connected to said plural actuators, storing a playback relation between target values of said reference velocity and target values of said velocity of said certain links therein, analyzing music data codes representative of at least said manipulated manipulators and said loudness of said tones so as to determine the target values of said reference velocity on the basis of said playback relation and controlling said manipulated manipulators to pass through said reference points at said reference values of said reference velocity, wherein at least a part of said playback relation is prepared through a transcription from a reference relation between target values of said reference velocity and measured values of the velocity of corresponding certain links of a master automatic player musical instrument, which is equipped with sensors for monitoring said corresponding certain links and actuators for driving corresponding manipulators at said target values of said reference velocity.

2. The automatic player musical instrument as set forth in claim 1, in which said automatic player further includes plural sensors connected to said data processing unit, respectively monitoring said plural manipulators and producing detecting signals representative of a physical quantity expressing said motion of said manipulated manipulators so that said data processing unit determines measured values of said reference velocity of said plural manipulators on the basis of measured values of said physical quantity, wherein said data processing unit further prepares another part of said playback relation through an experiment internally carried out at target values of said reference velocity with reference to a velocity converter accessed with said measured values of said reference velocity for determining a relation between said target values of said reference velocity and said target values of said velocity of said certain links.

3. The automatic player musical instrument as set forth in claim 2, in which said velocity converter defines a relation between measured values of said velocity of said corresponding certain links and measured values of said reference velocity of said corresponding manipulators determined by using said master automatic player musical instrument so that said data processing unit estimates said relation between said target values of said reference velocity and said target values of said velocity for said another part of said playback relation through the access to said velocity converter with said measured values of said reference velocity.

4. The automatic player musical instrument as set forth in claim 2, in which said plural sensors form a servo-control loop together with said plural actuators and said data processing unit in order to control said manipulated manipulators in such a manner as to pass through said reference points at said target values of said reference velocity.

5. The automatic player musical instrument as set forth in claim 1, in which said playback relation is stored in said data processing unit in the form of a playback table.

6. The automatic player musical instrument as set forth in claim 5, in which said playback table has plural data blocks respectively assigned to said plural manipulators, and each of said plural data blocks defines the playback relation between said target values of said velocity of the certain link connected to one of said plural manipulators and said target values of said reference velocity.

7. The automatic player musical instrument as set forth in claim 1, in which said part of said playback relation defines the relation between relatively large target values of said velocity of said certain links and said target values of said reference velocity.

8. The automatic player musical instrument as set forth in claim 7, in which said playback relation further has another part defining the relation between relatively small target values of said velocity and said target values of said reference velocity through access to a velocity converter defining a relation between measured values of said velocity of said corresponding certain links and measured values of said reference velocity of said corresponding manipulators determined by using said master automatic player musical instrument.

9. The automatic player musical instrument as set forth in claim 8, in which said automatic player further includes plural sensors monitoring said plural manipulators for measuring a physical quantity expressing said motion of said plural manipulators, and said data processing unit determines measured values of said reference velocity on the basis of measured values of said physical quantity so as to estimate said relation between said target values of said reference velocity of said manipulated manipulators and said target values of said velocity of said associated certain links through the access to said velocity converter with said measured values of said reference velocity.

10. The automatic player musical instrument as set forth in claim 9, in which said velocity converter is stored in said data processing unit in the form of a velocity conversion table.

11. The automatic player musical instrument as set forth in claim 8, in which said another part is merged with said part of said playback relation.

12. The automatic player musical instrument as set forth in claim 11, in which said another part is merged with said part through an interpolation.

13. The automatic player musical instrument as set forth in claim 1, in which a piano serves as said acoustic musical instrument.

14. The automatic player musical instrument as set forth in claim 13, in which black and white keys and hammers of said piano behave as said plural manipulators and said certain links, respectively.

15. The automatic player musical instrument as set forth in claim 14, in which said plural actuators are provided under rear portions of said black and white keys, and said automatic player further includes key sensors provided under front portions of said black and white keys so that said black and white keys not only rotate about but also jump over a balance rail when said plural actuators strongly pushes said rear portions so as to give rise to said motion of said manipulators at large target values of said reference velocity.

16. The automatic player musical instrument as set forth in claim 15, in which said part of said playback relation is applied to said musical data codes expressing large target values of said velocity of said certain links so as to determine said large target values of said reference velocity.

17. The automatic player musical instrument as set forth in claim 1, further comprising a recorder recording a performance on said plural manipulators in the form of said music data codes.

18. A method for controlling an automatic player musical instrument for producing tones without fingering of a human player, comprising the steps of:

a) fetching a music data code representative of at least a pitch of a tone to be produced and loudness of said tone in the form of a target velocity of a certain link forming a part of a tone generator responsive to a manipulator;

b) determining a target value of a reference velocity of said manipulator at a reference point on a reference trajectory with reference to a playback relation, at least a part of which is prepared through a transcription from a reference relation between target values of reference velocity of a corresponding manipulator and measured values of velocity of a corresponding certain link of a master automatic player musical instrument, which is equipped with a sensor for monitoring said corresponding certain link and an actuator for driving said corresponding manipulator; and c) controlling said manipulator so as to pass through said reference point at said target value of said reference velocity.

19. The method as set forth in claim 18, in which said playback relation is stored in the form of a playback table so that said target value of said reference velocity is read out from said playback table.

20. The method as set forth in claim 18, in which said playback relation further has another part prepared through an experiment internally carried out for determining measured values of said reference velocity of said manipulator and with reference to a velocity converter defining a relation between measured values of said velocity of said corresponding certain link and measured values of said reference velocity of said corresponding manipulator.

* * * * *